US009651240B2

(12) United States Patent
Bucklen et al.

(10) Patent No.: US 9,651,240 B2
(45) Date of Patent: May 16, 2017

(54) LED LAMP

(71) Applicant: Cree, Inc., Durham, NC (US)

(72) Inventors: Vincent Bucklen, Blacksburg, VA (US); Curt Progl, Raleigh, NC (US)

(73) Assignee: Cree, Inc., Durham, NC (US)

( * ) Notice: Subject to any disclaimer, the term of this patent is extended or adjusted under 35 U.S.C. 154(b) by 40 days.

(21) Appl. No.: 14/079,743

(22) Filed: Nov. 14, 2013

(65) Prior Publication Data

US 2015/0131293 A1 May 14, 2015

(51) Int. Cl.
*F21V 29/77* (2015.01)
*F21K 9/23* (2016.01)

(52) U.S. Cl.
CPC ..... *F21V 29/773* (2015.01); *F21K 9/23* (2016.08)

(58) Field of Classification Search
CPC .... F21V 29/004; F21V 29/2212; F21V 29/70; F21V 29/74; F21V 29/745; F21V 29/763; F21V 29/773; F21V 29/22; F21V 29/2206; F21K 9/135; F21K 9/50; F21K 9/1355; F21K 9/1375
USPC ..... 362/294
See application file for complete search history.

(56) References Cited

U.S. PATENT DOCUMENTS 3,581,162 A 5/1971 Wheatley
3,936,686 A 2/1976 Moore
5,463,280 A 10/1995 Johnson
5,561,346 A 10/1996 Byrne
5,585,783 A 12/1996 Hall
5,655,830 A 8/1997 Ruskouski
5,688,042 A 11/1997 Madadi et al.
5,806,965 A 9/1998 Deese
5,843,808 A 12/1998 Karnezos
5,947,588 A 9/1999 Huang
(Continued)

FOREIGN PATENT DOCUMENTS

CN 100552286 C 10/2009
DE 102007034123 A1 1/2009
(Continued)

OTHER PUBLICATIONS

Cree, Inc., International Application No. PCT/US2014/052120, International Search Report and Written Opinion, Nov. 11, 2014.
(Continued)

*Primary Examiner* — David V Bruce
(74) *Attorney, Agent, or Firm* — Dennis J. Williamson; Moore & Van Allen PLLC

(57) ABSTRACT

A lamp includes an enclosure that is at least partially optically transmissive and a base. One or more LEDs are located in the enclosure and are operable to emit light when energized through an electrical path from the base. A heat sink having a heat dissipating portion that is at least partially exposed to the ambient environment and a heat conducting portion that is thermally coupled to the at least one LED transfers heat from the LEDs to the ambient environment. The heat sink includes fins that are located in the enclosure. A housing is press fit between the heat dissipating portion and the heat conducting portion and forms part of the heat sink. The housing is thermally coupled to the heat sink and is made of thermally conductive material and is at least partially exposed to the ambient environment. The housing defines at least a portion of the enclosure.

18 Claims, 19 Drawing Sheets

(56) References Cited

U.S. PATENT DOCUMENTS

| | | | | |
|---|---|---|---|---|
| 5,949,347 | A | 9/1999 | Wu | |
| 6,161,910 | A | 12/2000 | Reisenauer et al. | |
| 6,220,722 | B1 | 4/2001 | Begemann | |
| 6,227,679 | B1 | 5/2001 | Zhang et al. | |
| 6,234,648 | B1 | 5/2001 | Borner et al. | |
| 6,250,774 | B1 | 6/2001 | Begemann et al. | |
| 6,276,822 | B1 | 8/2001 | Bedrosian et al. | |
| 6,414,801 | B1 | 7/2002 | Roller | |
| 6,465,961 | B1 | 10/2002 | Cao | |
| 6,523,978 | B1 | 2/2003 | Huang | |
| 6,550,953 | B1 | 4/2003 | Ichikawa et al. | |
| 6,634,770 | B2 | 10/2003 | Cao | |
| 6,659,632 | B2 | 12/2003 | Chen | |
| 6,709,132 | B2 | 3/2004 | Ishibashi | |
| 6,803,607 | B1 | 10/2004 | Chan et al. | |
| 6,848,819 | B1 | 2/2005 | Arndt et al. | |
| 6,853,151 | B2 | 2/2005 | Leong | |
| 6,864,513 | B2 | 3/2005 | Lin et al. | |
| 6,936,855 | B1 | 8/2005 | Harrah | |
| 6,948,829 | B2 | 9/2005 | Verdes et al. | |
| 6,982,518 | B2 | 1/2006 | Chou et al. | |
| 7,048,412 | B2 | 5/2006 | Martin et al. | |
| 7,080,924 | B2 | 7/2006 | Tseng et al. | |
| 7,086,756 | B2 | 8/2006 | Maxik | |
| 7,086,767 | B2 | 8/2006 | Sidwell et al. | |
| 7,144,135 | B2 | 12/2006 | Martin et al. | |
| 7,165,866 | B2 | 1/2007 | Li | |
| 7,172,314 | B2 | 2/2007 | Currie et al. | |
| 7,213,940 | B1 | 5/2007 | Van De Ven et al. | |
| 7,354,174 | B1 | 4/2008 | Yan | |
| 7,396,142 | B2 | 7/2008 | Laizure, Jr. et al. | |
| 7,434,964 | B1 | 10/2008 | Zheng et al. | |
| 7,600,882 | B1 | 10/2009 | Morejon et al. | |
| 7,726,836 | B2 | 6/2010 | Chen | |
| 7,819,562 | B2 | 10/2010 | Freeman et al. | |
| 7,824,065 | B2 | 11/2010 | Maxik | |
| 7,965,023 | B1 | 6/2011 | Liang | |
| 8,021,025 | B2 * | 9/2011 | Lee | 362/373 |
| 8,253,316 | B2 | 8/2012 | Sun et al. | |
| 8,272,762 | B2 * | 9/2012 | Maxik et al. | 362/249.02 |
| 8,274,241 | B2 * | 9/2012 | Guest et al. | 315/294 |
| 8,277,082 | B2 | 10/2012 | Dassanayake et al. | |
| 8,282,249 | B2 | 10/2012 | Liang et al. | |
| 8,282,250 | B1 | 10/2012 | Dassanayake et al. | |
| 8,292,468 | B2 | 10/2012 | Narendran et al. | |
| 8,322,896 | B2 | 12/2012 | Falicoff et al. | |
| 8,371,722 | B2 | 2/2013 | Carroll | |
| 8,400,051 | B2 | 3/2013 | Hakata et al. | |
| 8,415,865 | B2 | 4/2013 | Liang et al. | |
| 8,421,320 | B2 | 4/2013 | Chuang | |
| 8,421,321 | B2 | 4/2013 | Chuang | |
| 8,421,322 | B2 | 4/2013 | Carroll et al. | |
| 8,427,037 | B2 | 4/2013 | Liang et al. | |
| 8,449,154 | B2 | 5/2013 | Uemoto et al. | |
| 8,476,836 | B2 | 7/2013 | Van De Ven et al. | |
| 8,502,468 | B2 | 8/2013 | Li et al. | |
| 8,556,465 | B2 | 10/2013 | Lee et al. | |
| 8,641,237 | B2 | 2/2014 | Chuang | |
| 8,653,723 | B2 * | 2/2014 | Cao et al. | 313/46 |
| 8,680,754 | B2 | 3/2014 | Premysler | |
| 8,696,168 | B2 | 4/2014 | Li et al. | |
| 8,740,415 | B2 * | 6/2014 | Wheelock | 362/294 |
| 8,750,671 | B1 | 6/2014 | Kelly et al. | |
| 8,752,984 | B2 | 6/2014 | Lenk et al. | |
| 8,760,042 | B2 | 6/2014 | Sakai et al. | |
| 9,030,120 | B2 | 5/2015 | Pickard et al. | |
| 2001/0026440 | A1 | 10/2001 | Mellberg et al. | |
| 2003/0063476 | A1 | 4/2003 | English et al. | |
| 2004/0201990 | A1 | 10/2004 | Meyer | |
| 2005/0174769 | A1 | 8/2005 | Yong et al. | |
| 2005/0207152 | A1 | 9/2005 | Maxik | |
| 2007/0268694 | A1 | 11/2007 | Bailey et al. | |
| 2008/0037255 | A1 | 2/2008 | Wang | |
| 2008/0316755 | A1 | 12/2008 | Zheng et al. | |
| 2009/0184618 | A1 | 7/2009 | Hakata et al. | |
| 2010/0259925 | A1 | 10/2010 | Hsu et al. | |
| 2010/0264800 | A1 * | 10/2010 | Liu et al. | 313/46 |
| 2012/0040585 | A1 | 2/2012 | Huang | |
| 2012/0057327 | A1 | 3/2012 | Le et al. | |
| 2012/0155059 | A1 * | 6/2012 | Hoelen et al. | 362/84 |
| 2013/0026923 | A1 | 1/2013 | Athalye et al. | |
| 2013/0026925 | A1 | 1/2013 | Ven et al. | |
| 2013/0058098 | A1 * | 3/2013 | Kim | F21V 29/004 362/294 |
| 2013/0069535 | A1 | 3/2013 | Athalye | |
| 2013/0069547 | A1 | 3/2013 | Van De Ven et al. | |
| 2013/0070461 | A1 | 3/2013 | Pickard | |
| 2013/0088848 | A1 | 4/2013 | Lee et al. | |
| 2013/0127353 | A1 | 5/2013 | Athalye et al. | |
| 2013/0148341 | A1 * | 6/2013 | Williams | 362/184 |
| 2013/0162149 | A1 | 6/2013 | Van De Ven et al. | |
| 2013/0162153 | A1 | 6/2013 | Van De Ven et al. | |
| 2013/0169159 | A1 | 7/2013 | Lys | |
| 2013/0170221 | A1 | 7/2013 | Isogai et al. | |
| 2013/0271981 | A1 | 10/2013 | Hussell et al. | |
| 2013/0293135 | A1 | 11/2013 | Hu et al. | |
| 2014/0218932 | A1 * | 8/2014 | Huang | 362/294 |
| 2014/0340870 | A1 | 11/2014 | Premysler | |

FOREIGN PATENT DOCUMENTS

| | | | |
|---|---|---|---|
| EP | 1058221 | A2 | 12/2000 |
| EP | 0890059 | B1 | 6/2004 |
| EP | 1645794 | A2 | 4/2006 |
| EP | 2413029 | A2 | 2/2012 |
| GB | 2345954 | A | 7/2000 |
| JP | H09265807 | A | 10/1997 |
| JP | 2000173304 | A | 6/2000 |
| JP | 2001118403 | A | 4/2001 |
| JP | 2007059930 | A | 3/2007 |
| JP | 2008288183 | A | 11/2008 |
| JP | 2009117346 | A | 5/2009 |
| JP | 3153766 | U | 9/2009 |
| JP | 2009277586 | A | 11/2009 |
| TW | M286462 | U | 1/2006 |
| TW | M360982 | U | 7/2009 |
| WO | 0114789 | A1 | 1/2001 |
| WO | 0124583 | A1 | 4/2001 |
| WO | 0160119 | A2 | 8/2001 |
| WO | 2012011279 | A1 | 1/2012 |
| WO | 2012031533 | A1 | 3/2012 |

OTHER PUBLICATIONS

Cree, Inc., European Application No. 13716151.9, Office Action, Nov. 28, 2014.
Cree, Inc., International Application No. PCT/US2014/036283, International Search Report and Written Opinion, Feb. 19, 2015.
Cree, Inc., Taiwanese Application No. 102113095, Official Letter, Nov. 30, 2015.
Energy Star® Program Requirements for Integral LED Lamps, Mar. 22, 2010, pp. 1-30.
U.S. Appl. No. 13/939,821, Office Action, Jul. 6, 2015.
U.S. Appl. No. 14/268,003, Office Action, Jul. 6, 2015.
U.S. Appl. No. 13/875,670, Office Action, Jul. 9, 2015.
U.S. Appl. No. 13/446,759, Final Office Action, Feb. 9, 2015.
U.S. Appl. No. 13/467,670, Final Office Action, Mar. 11, 2015.
U.S. Appl. No. 13/939,827, Office Action, Jul. 15, 2015.
U.S. Appl. No. 14/010,868, Office Action, Apr. 16, 2015.
U.S. Appl. No. 13/446,759, Final Office Action, Dec. 22, 2015.
U.S. Appl. No. 13/446,759, Office Action, Jul. 27, 2015.
U.S. Appl. No. 13/774,078, Final Office Action, Oct. 22, 2015.
Cree, Inc., Chinese Patent Application No. 2013800313033.3, First Office Action, Jan. 23, 2017.

* cited by examiner

LED LAMP

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

SUMMARY OF THE INVENTION

In some embodiments a lamp comprises an enclosure that is at least partially optically transmissive and a base. At least one LED is located in the enclosure and is operable to emit light when energized through an electrical path from the base. A heat sink comprises a heat dissipating portion that is at least partially exposed to the ambient environment and a heat conducting portion that is thermally coupled to the at least one LED. A housing is press fit between the heat dissipating portion and the heat conducting portion.

The base may comprise an Edison connector. The at least one LED may be mounted on the heat sink in a center of the enclosure. The at least one LED may be attached to a submount and the submount may be thermally and mechanically coupled to the heat sink. The housing may support at least a portion of the enclosure. The housing may be at least partially exposed to an exterior of the lamp. The housing may support a lens. The housing may support a reflective surface. The reflective surface may be part of a reflector component mounted inside of the housing. The heat conducting portion may comprise fins that engage the housing. The housing may comprise a flange that is trapped between the fins and a wall of the heat sink. A thermal path may be created between the heat conducting portion and the housing through the fins. The housing may define a portion of the enclosure. The housing may be made of a thermally conductive material.

In some embodiments a lamp comprises an enclosure that is at least partially optically transmissive and a base. At least one LED is located in the enclosure and is operable to emit light when energized through an electrical path from the base. A heat sink comprises a heat dissipating portion that is at least partially exposed to the ambient environment and a heat conducting portion that is thermally coupled to the at least one LED. A housing is press fit to the heat sink such that a thermal path is created between the heat sink and the housing where at least a portion of the housing is external to the enclosure.

In some embodiments a lamp comprises an enclosure that is at least partially optically transmissive and a base. At least one LED located in the enclosure and operable to emit light when energized through an electrical path from the base. A heat sink is at least partially exposed to the ambient environment for conducting heat from the at least one LED to the ambient environment. A housing is thermally coupled to the heat sink. The housing is made of thermally conductive material and is at least partially exposed to the ambient environment where the housing defines at least a portion of the enclosure.

In some embodiments, a lamp comprises an enclosure that is at least partially optically transmissive. A base comprises electrical connections. At least one LED is located in the enclosure and operable to emit light when energized through the electrical connections in the base. A heat sink comprises a heat dissipating portion that is at least partially exposed to the ambient environment and a heat conducting portion that comprises a tower that extends into the enclosure and that is thermally coupled to the at least one LED. At least one fin is thermally coupled to the tower within the enclosure. The at least one fin extends from the tower to an exterior of the enclosure.

DETAILED DESCRIPTION

Figure 1:
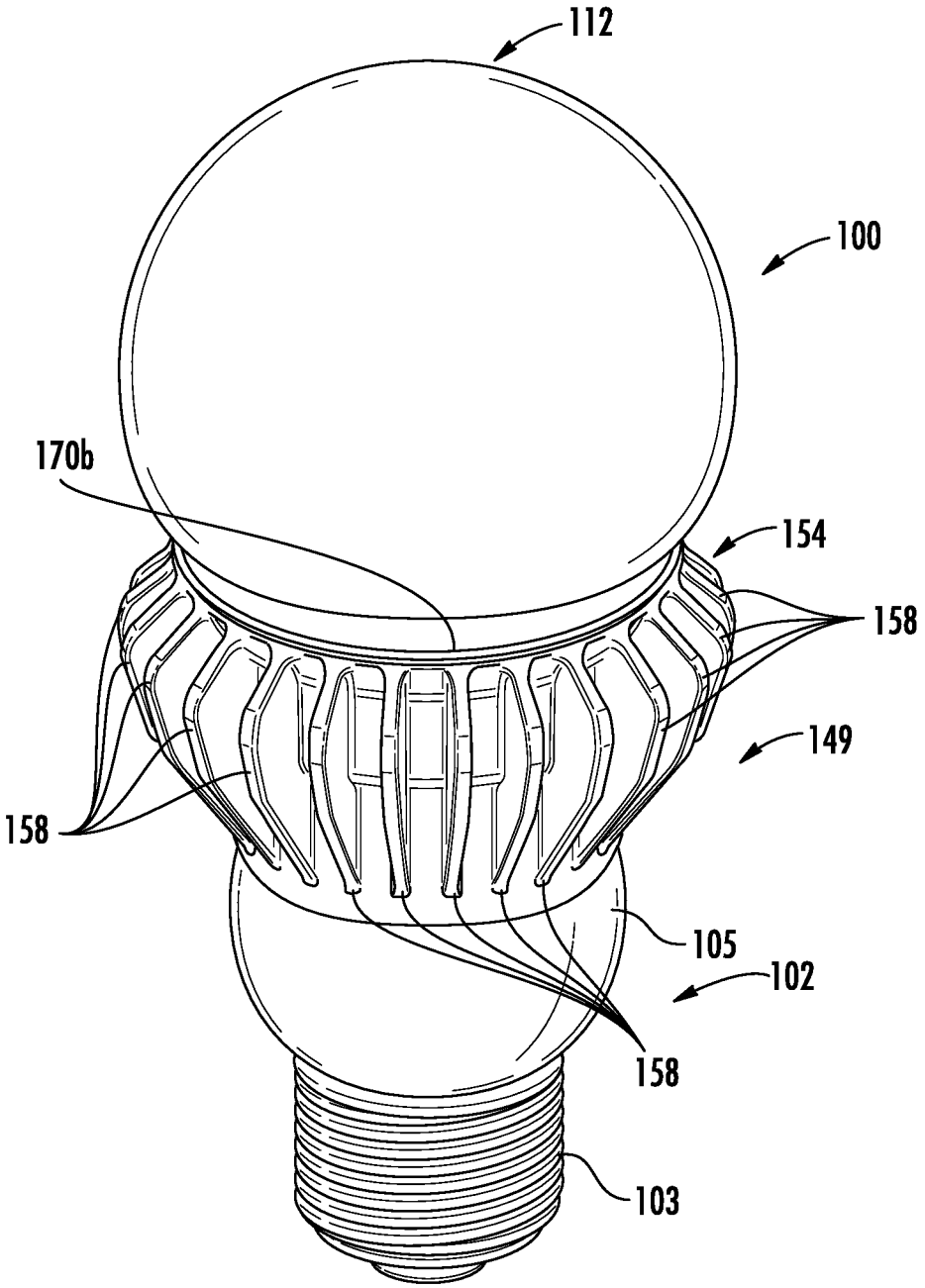
FIG. 1 is a perspective view of an embodiment of a lamp of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

Any aspect or features of any of the embodiments described herein can be used with any feature or aspect of any other embodiments described herein or integrated together or implemented separately in single or multiple components.

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters may be used in a single device, such as to produce light perceived as white or near white in character. In certain embodiments, the aggregated output of multiple solid-state light emitters may generate warm white light output having a color temperature range of from about 2200K to about 6000K.

Solid state light emitters may be used individually or in combination with one or more lumophoric materials (e.g., phosphors, scintillators, lumiphoric inks, luminophores, lumophores, lumiphores) to generate light at a peak wavelength, or of at least one desired perceived color (including combinations of colors that may be perceived as white). Inclusion of lumophoric (also called 'luminescent') materials in lighting devices may be accomplished by coating on, or embedding or dispersing such lumophoric materials within a lumophoric support medium. Other materials, such as light scattering elements (e.g., particles) and/or index matching materials, may be associated with the lumophoric material or the lumophoric material support medium.

Embodiments of the present invention provide a solid-state lamp with centralized LEDs. Multiple LEDs can be used together, forming an LED array. The LEDs can be mounted on or fixed within the lamp in various ways. In at least some example embodiments, a submount is used. The LEDs may be disposed at or near the central portion of the structural envelope of the lamp. Since the LED array may be configured in some embodiments to reside centrally within the structural envelope of the lamp, a lamp can be constructed so that the light pattern is not adversely affected by the presence of a heat sink and/or mounting hardware, or by having to locate the LEDs close to the base of the lamp.

FIGS. 1 through 4 show a lamp, 100, according to some embodiments of the present invention. Lamp 100 may be used as a lamp with an Edison base 102 and, more particularly; lamp 100 may be designed to serve as a solid-state replacement for an A19, A21, or A23 incandescent bulb or similar bulb. The Edison base 102 as shown and described herein may be implemented through the use of an Edison connector 103 and a plastic form 105. An at least partially optically transmissive enclosure 112 surrounds the LEDs to emit light from the lamp. A plurality of LEDs 127 are supported in the enclosure 112 and are operable to emit light when energized through an electrical path from the base 102. The LEDs 127 may be mounted on a submount 129 to create an LED assembly 130 and are operable to emit light when energized through an electrical connection. In the present invention the term "submount" is used to refer to the support structure that supports the individual LEDs or LED packages and in one embodiment comprises a printed circuit board or "PCB" such as a metal core printed circuit board "MCPCB" although it may comprise other structures such as a lead frame extrusion or the like or combinations of such structures. In some embodiments, a driver or power supply may be included with the LED array on the submount. In some cases the driver may be formed by components on the PCB. Multiple LEDs 127 can be used together, forming an LED array. The LEDs 127 can be mounted on or fixed within the lamp in various ways. The LEDs 127 in the LED array include LEDs which may comprise an LED die disposed in an encapsulant such as silicone. A wide variety of LEDs and combinations of LEDs may be used in the LED assembly 130 as described herein.

While a lamp having the size and form factor of a standard-sized household incandescent bulb is shown, the lamp may have other the sizes and form factors. For example, the lamp may be a replacement for a PAR-style or a BR-style incandescent bulb as will be described herein. In other embodiments, the lamp may have a form factor of other standard or non-standard bulbs.

Figure 15:
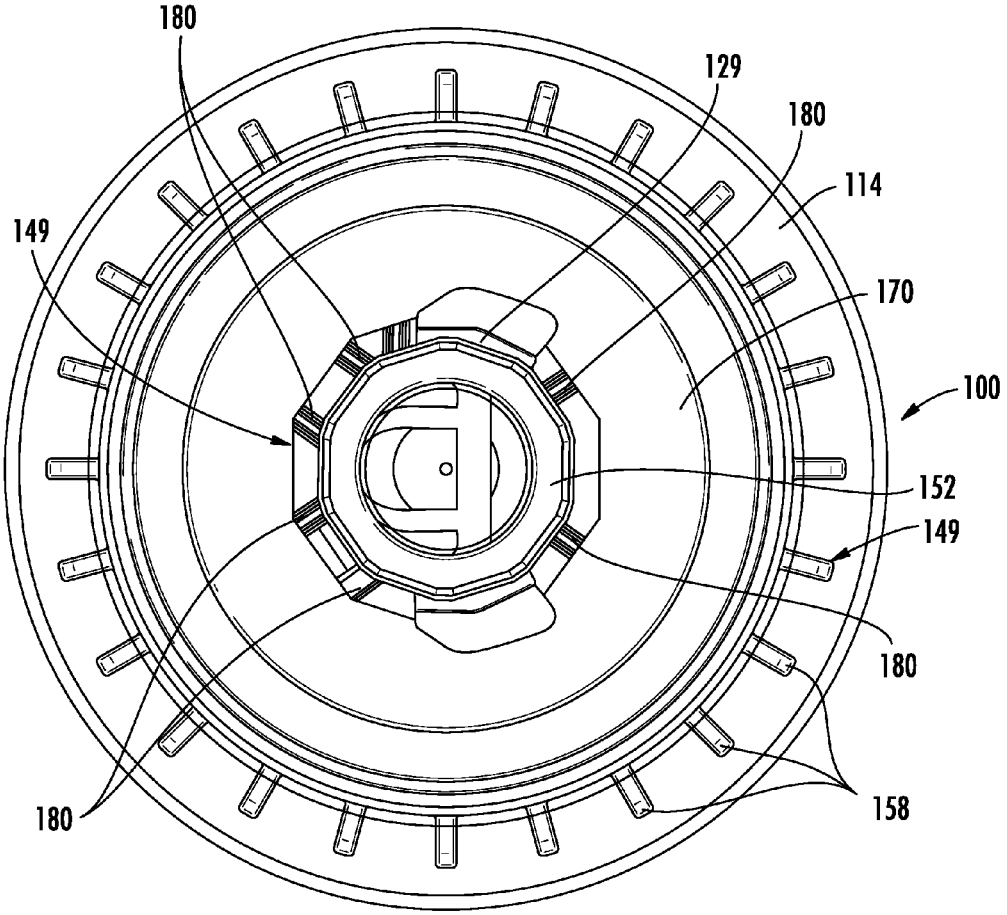
FIG. 15 is a top view of the lamp of FIG. 1 where the enclosure is clear to show the interior of the lamp.
Figure 16:
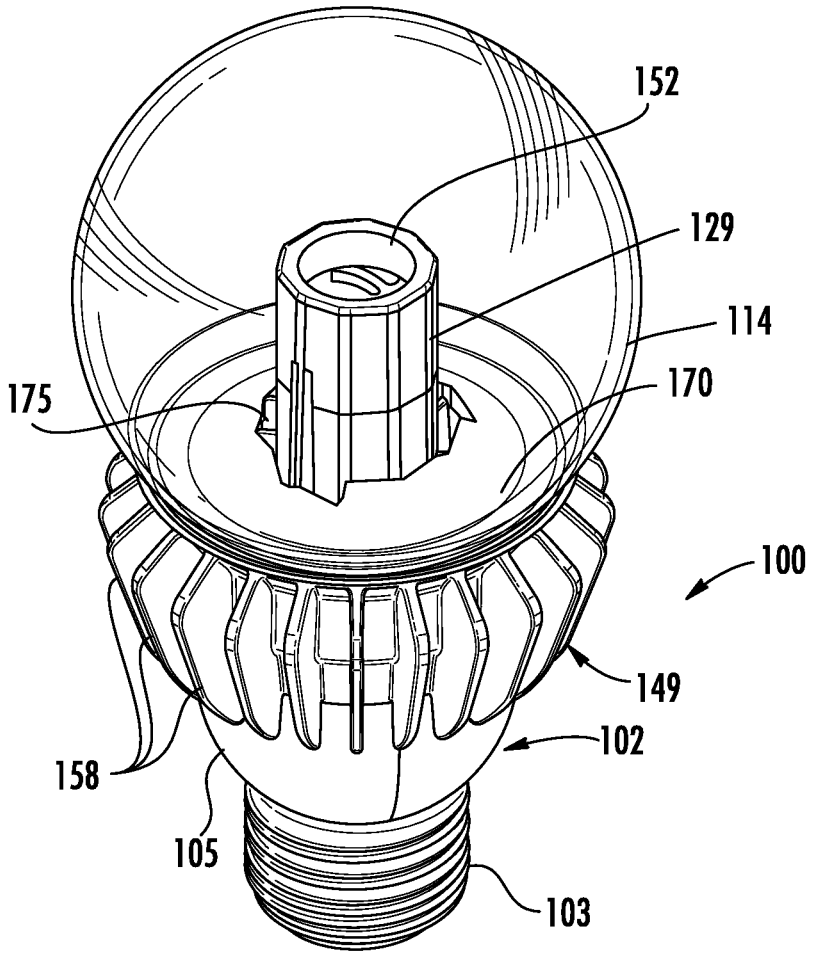
FIG. 16 is a perspective view of the lamp of FIG. 15.
Figure 17:
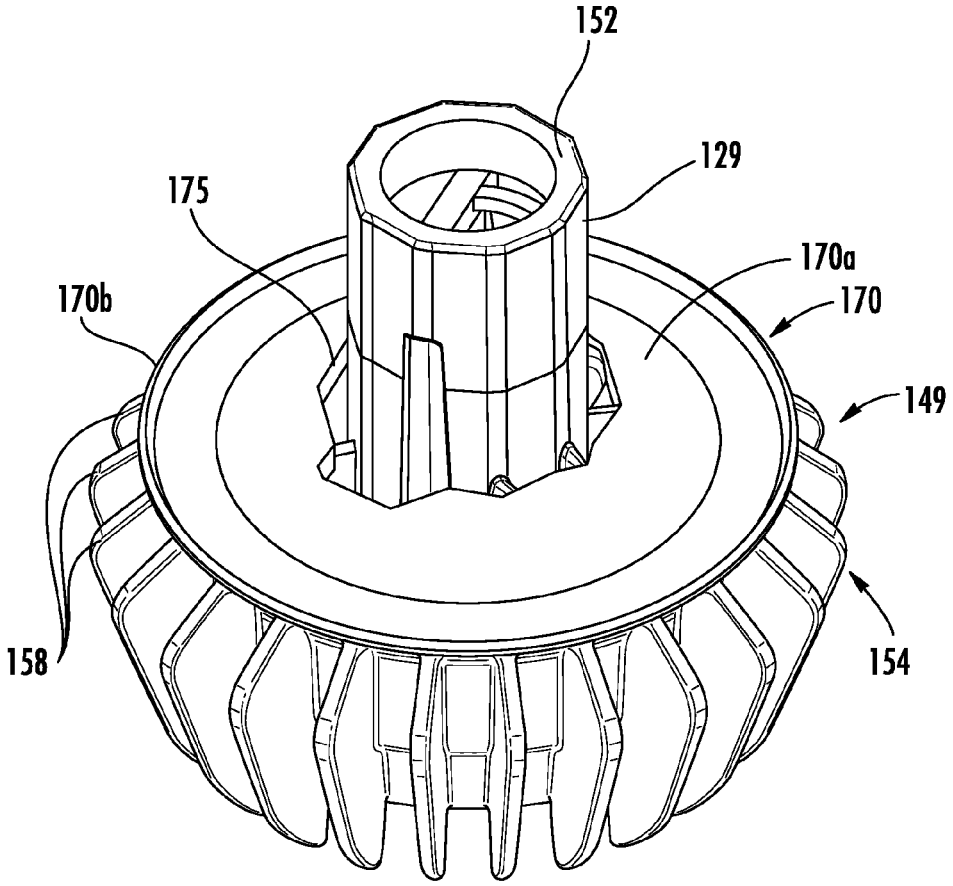
FIG. 17 is a perspective view of the heat sink and housing usable in an omnidirectional lamp.
Figure 18:
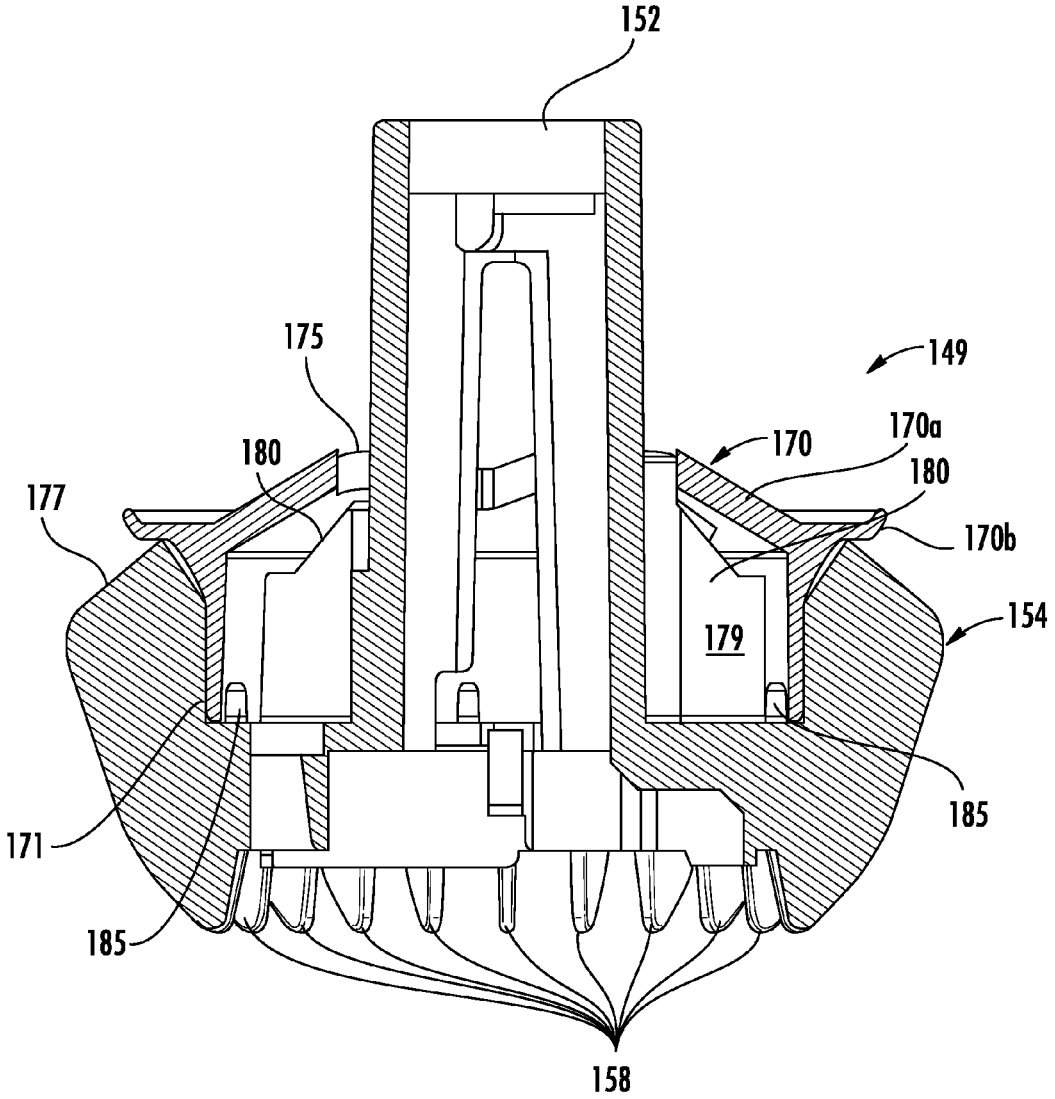
FIG. 18 is a section view of the heat sink and housing of FIG. 17.
Figure 19:
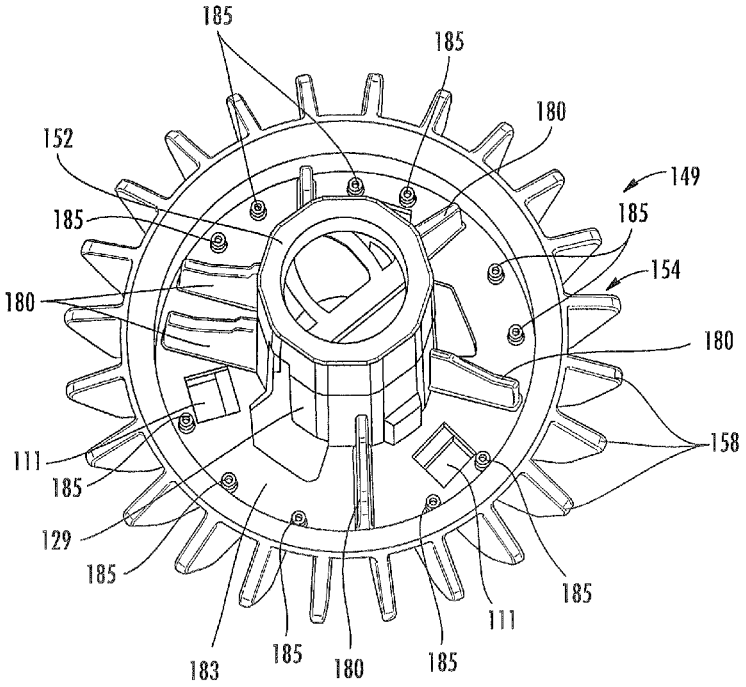
FIGS. 19 and 20 are top perspective views of the heat sink usable in embodiments of the invention.
Figure 20:
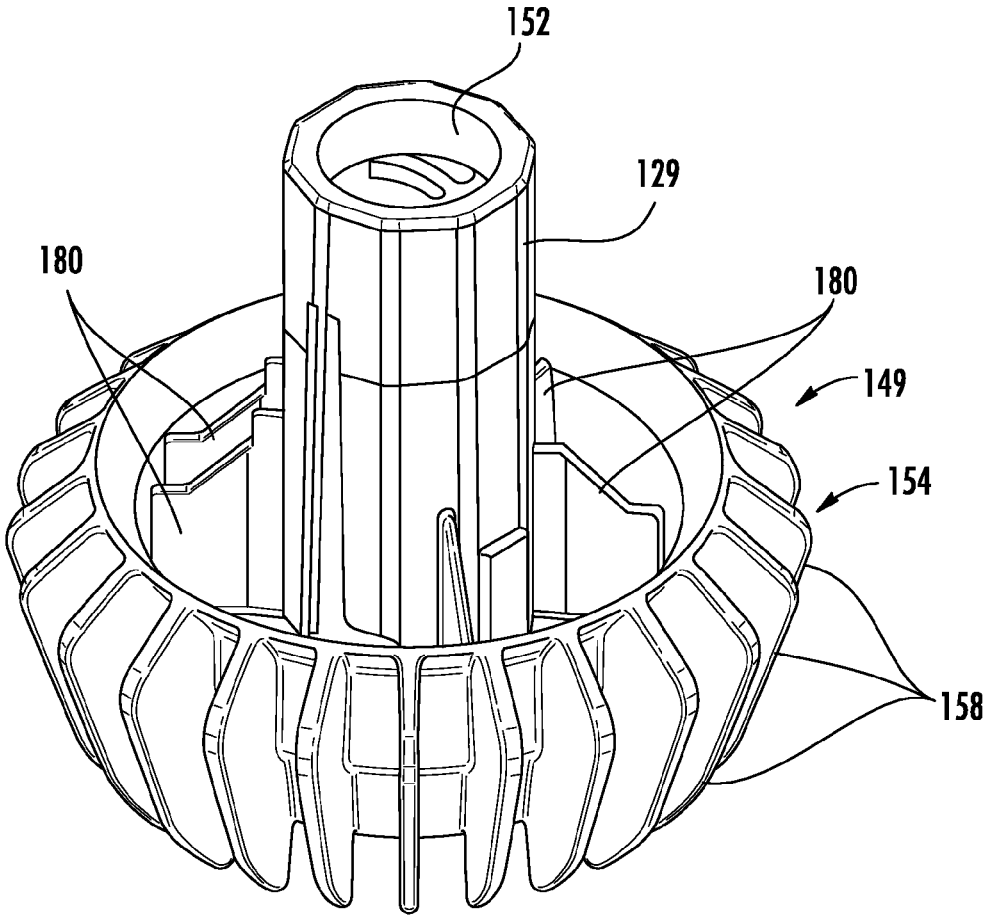
Figure 21:
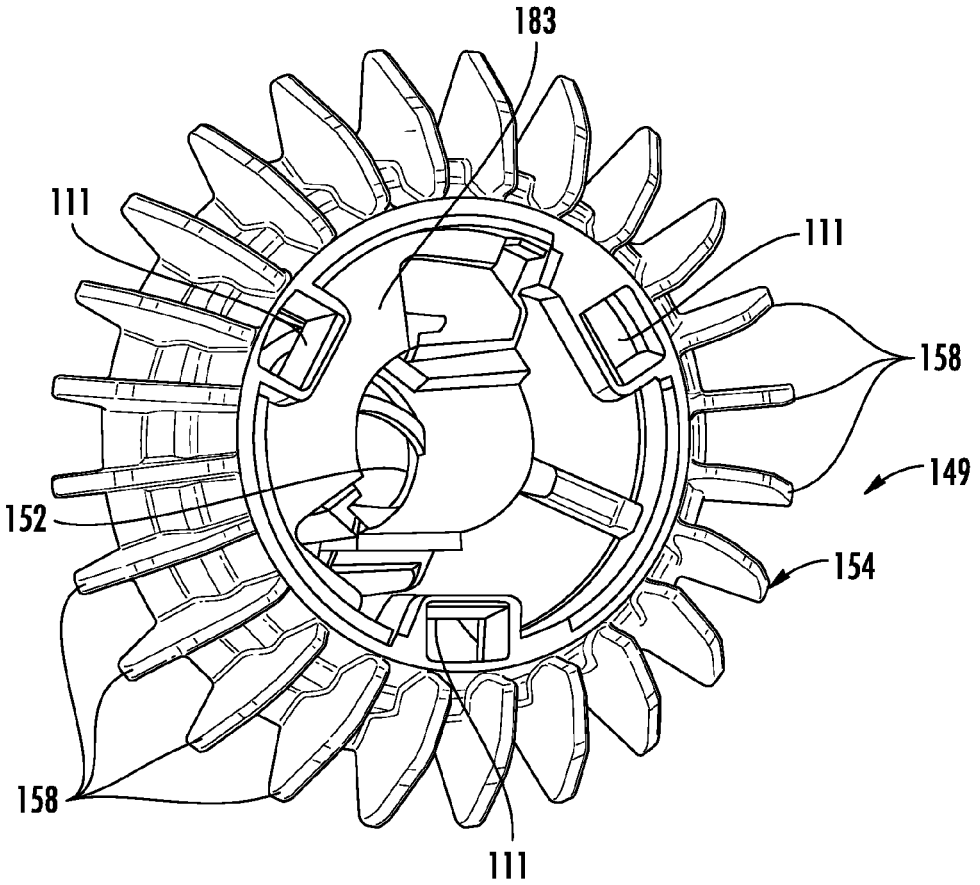
FIG. 21 is a bottom perspective view of the heat sink usable in embodiments of the invention.

Enclosure 112 comprises, in some embodiments, a translucent, transparent or other light transmissive globe portion made of glass, quartz, borosilicate, silicate, polycarbonate, other plastic or other suitable material. The enclosure 112 may be of similar shape to that commonly used in household incandescent bulbs. In some embodiments, the enclosure is coated on the inside with silica, providing a diffuse scattering layer that produces a more uniform far field pattern. The enclosure may also be etched, frosted or coated. Alternatively, the surface treatment may be omitted and a clear enclosure may be provided as shown in FIGS. 15 and 16. The enclosure may also be provided with a shatter proof or shatter resistant coating. The enclosure 112 may have a traditional bulb shape having a globe shaped main body 114 that tapers to a narrower neck 115 that defines an opening into the enclosure.

A lamp base 102 such as an Edison connector 103 functions as the electrical connector to connect the lamp 100 to an electrical socket or other connector. Depending on the embodiment, other base configurations are possible to make the electrical connection such as other standard bases or non-traditional bases. Base 102 may include the electronics 110 for powering lamp 100 and may include a power supply and/or driver and form all or a portion of the electrical path between the mains and the LEDs. Base 102 may also include only part of the power supply circuitry while some smaller components reside on the submount 129. The LEDs 127 are operable to emit light when energized through an electrical connection. An electrical path such as conductors 107 runs between the submount 129 and the lamp base 102 to carry both sides of the supply to provide critical current to the LEDs 127. With the embodiments of a lamp disclosed herein, as with many other embodiments of the invention, the term "electrical path" can be used to refer to the entire electrical path to the LEDs, including an intervening power supply disposed between the electrical connection that would otherwise provide power directly to the LEDs, or it may be used to refer to the connection between the mains and all the electronics in the lamp, including the power supply. The term may also be used to refer to the connection between the power supply and the LED array. Electrical conductors 107 run between the LED assembly 130 and the lamp electronics 110 in base 102 to carry both sides of the supply to provide critical current to the LEDs 127. In some embodiments, an electrical interconnect may be used where the electrical interconnect provides the electrical connection between the LED assembly 130 and the lamp electronics 110. Such an electrical interconnect is shown and described in U.S. patent application Ser. No. 13/774,078, filed on Feb. 22, 2013 and titled "LED Lamp" which is incorporated herein by reference in its entirety.

The base 102 comprises an electrically conductive Edison screw 103 for connecting to an Edison socket and a housing portion 105 connected to the Edison screw 103. The Edison screw 103 may be connected to the housing portion 105 by adhesive, mechanical connector, welding, separate fasteners or the like. The housing portion 105 may comprise an electrically insulating material such as plastic. Further, the material of the housing portion 105 may comprise a thermally conductive material such that the housing portion 105 may form part of the heat sink structure for dissipating heat from the lamp 100. The housing portion 105 and the Edison screw 103 define an internal cavity for receiving the electronics 110 of the lamp. The lamp electronics may comprise printed a circuit board 111 which includes the power supply, including large capacitor and EMI components that are across the input AC line along with the driver circuitry as described herein. The lamp electronics 110 are electrically coupled to the Edison screw 103 such that the electrical connection may be made from the Edison screw 103 to the lamp electronics 110. The base 102 may be potted to physically and electrically isolate and protect the lamp electronics 110.

In some embodiments, a driver and/or power supply are included with the LEDs on the submount 129. In other embodiments the driver and/or power supply are included in the base 102 as shown. The power supply and drivers may also be mounted separately where components of the power supply are mounted in the base 102 and the driver is mounted with the submount 129 in the enclosure 112. Base 102 may include a power supply or driver and form all or a portion of the electrical path between the mains and the LEDs 127. The base 102 may also include only part of the power supply circuitry while some smaller components reside on the submount 129. In some embodiments any component that goes directly across the AC input line may be in the base 102 and other components that assist in converting the AC to useful DC may be in the glass enclosure 112. In one example embodiment, the inductors and capacitor that form part of the EMI filter are in the Edison base. Suitable power supplies and drivers are described in U.S. patent application Ser. No. 13/462,388 filed on May 2, 2012 and titled "Driver Circuits for Dimmable Solid State Lighting Apparatus" which is incorporated herein by reference in its entirety; U.S. patent application Ser. No. 12/775,842 filed on May 7, 2010 and titled "AC Driven Solid State Lighting Apparatus with LED String Including Switched Segments" which is incorporated herein by reference in its entirety; U.S. patent application Ser. No. 13/192,755 filed Jul. 28, 2011 titled "Solid State Lighting Apparatus and Methods of Using Integrated Driver Circuitry" which is incorporated herein by reference in its entirety; U.S. patent application Ser. No. 13/339,974 filed Dec. 29, 2011 titled "Solid-State Lighting Apparatus and Methods Using Parallel-Connected Segment Bypass Circuits" which is incorporated herein by reference in its entirety; U.S. patent application Ser. No. 13/235,103 filed Sep. 16, 2011 titled "Solid-State Lighting Apparatus and Methods Using Energy Storage" which is incorporated herein by reference in its entirety; U.S. patent application Ser. No. 13/360,145 filed Jan. 27, 2012 titled "Solid State Lighting Apparatus and Methods of Forming" which is incorporated herein by reference in its entirety; U.S. patent application Ser. No. 13/338,095 filed Dec. 27, 2011 titled "Solid-State Lighting Apparatus Including an Energy Storage Module for Applying Power to a Light Source Element During Low Power Intervals and Methods of Operating the Same" which is incorporated herein by reference in its entirety; U.S. patent application Ser. No. 13/338,076 filed Dec. 27, 2011 titled "Solid-State Lighting Apparatus Including Current Diversion Controlled by Lighting Device Bias States and Current Limiting Using a Passive Electrical Component" which is incorporated herein by reference in its entirety; and U.S. patent application Ser. No. 13/405,891 filed Feb. 27, 2012 titled "Solid-State Lighting Apparatus and Methods Using Energy Storage" which is incorporated herein by reference in its entirety.

The AC to DC conversion may be provided by a boost topology to minimize losses and therefore maximize conversion efficiency. The boost supply may be connected to high voltage LEDs operating at greater than 200V. Other embodiments are possible using different driver configurations, or a boost supply at lower voltages. Examples of boost topologies are described in U.S. patent application Ser. No. 13/462,388, entitled "Driver Circuits for Dimmable Solid State Lighting Apparatus", filed on May 2, 2012 which is incorporated by reference herein in its entirety; and U.S. patent application Ser. No. 13/662,618, entitled "Driving Circuits for Solid-State Lighting Apparatus with High Voltage LED Components and Related Methods", filed on Oct. 29, 2012 which is incorporated by reference herein in its entirety. With boost technology there is a relatively small power loss when converting from AC to DC. For example, boost technology may be approximately 92% efficient while other power converting technology, such as Bud technology, may be approximately 85% efficient. Using a less efficient conversion technology decreases the efficiency of the system such that significant losses occur in the form of heat. The increase in heat must be dissipated from the lamp because heat adversely affects the performance characteristics of the LEDs. The increase in efficiency using boost technology maximizes power to the LEDs while minimizing heat generated as loss. As a result, use of boost topology, or other highly efficient topology, provides an increase in the overall efficiency of the lamp and a decrease in the heat generated by the power supply; however, other topolodgies may be used.

The LED assembly 130 comprises a submount 129 arranged such that the LEDs are positioned at the approximate center of enclosure 112. As used herein the terms "center of the enclosure" and/or "optical center of the enclosure" refers to the vertical position of the LEDs in the enclosure as being aligned with the approximate largest diameter area of the globe shaped main body 114. "Vertical" as used herein means along the longitudinal axis of the bulb where the longitudinal axis extends from the base to the free end of the bulb as represented for example by line A-A in FIG. 2. The terms "center of the enclosure" and "optical center of the enclosure" do not necessarily mean the exact center of the enclosure and are used to signify that the LEDs are located along the longitudinal axis of the lamp at a position between the ends of the enclosure near a central portion of the enclosure. In one embodiment, the LEDs are arranged in the approximate location that the visible glowing filament is disposed in a standard incandescent bulb. In the lamp of the invention, the LEDs 127 are arranged at or near the optical center of the enclosure 112 in order to efficiently transmit the lumen output of the LED assembly through the enclosure 112. Locating the LEDs at the optical center of the lamp also creates a bright spot of light near the optical center of the bulb in the same location as the glowing filament in a traditional incandescent bulb such that the lamp of the invention mimics the glow of a traditional incandescent bulb. In the various embodiments described herein, the LED assembly is in the form of an LED tower 152 within the enclosure, the LEDs 127 are mounted on the LED tower 152 in a manner that mimics the appearance of a traditional incandescent bulb. As a result, the lamps of the invention provide similar optical light patterns to a traditional incandescent bulb and provide a similar physical appearance during use.

In one embodiment, the enclosure and base are dimensioned to be a replacement for an ANSI standard A19, A21, and/or A23 bulb such that the dimensions of the lamp 100 fall within the ANSI standards for such bulbs. The dimensions may be different for other ANSI standards. While specific reference has been made with respect to an A-series lamp with an Edison base 102, the structure and assembly method may be used on other lamps such as a PAR-style lamp such as a replacement for a PAR-38 incandescent bulb or a BR-style lamp. In other embodiments, the LED lamp can have any shape, including standard and non-standard shapes.

The submount 129 may comprise a series of anodes and cathodes arranged in pairs for connection to the LEDs 127. Moreover, more than one submount may be used to make a single LED assembly 130. Connectors or conductors such as traces connect the anode from one pair to the cathode of the adjacent pair to provide the electrical path between the anode/cathode pairs during operation of the LED assembly 130. An LED or LED package containing at least one LED 127 is secured to each anode and cathode pair where the LED/LED package spans the anode and cathode. The LEDs/LED packages may be attached to the submount by soldering. The submount 129 is thermally and mechanically coupled to the heat sink 149 such that heat may be dissipated from the LED assembly via the heat sink. The submount 129 may be made of a thermally conductive material. The entire area of the submount 129 may be thermally conductive such that the LED assembly 130 transfers heat to the heat sink 149. The submount 129 may be attached to the heat sink 149 using a press fit, thermal adhesive, a mechanical connector, brazing or other mechanism.

LEDs and/or LED packages used with an embodiment of the invention and can include light emitting diode chips that emit hues of light that, when mixed, are perceived in combination as white light. Phosphors can be used as described to add yet other colors of light by wavelength conversion. For example, blue or violet LEDs can be used in the LED assembly of the lamp and the appropriate phosphor can be used to create white light. LED devices can be used with phosphorized coatings packaged locally with the LEDs or with a phosphor coating the LED die as previously described. For example, blue-shifted yellow (BSY) LED devices, which typically include a local phosphor, can be used with a red phosphor on or in the optically transmissive enclosure or inner envelope to create substantially white light, or combined with red emitting LED devices in the array to create substantially white light.

A lighting system using the combination of BSY and red LED devices referred to above to make substantially white light can be referred to as a BSY plus red or "BSY+R" system. In such a system, the LED devices used include LEDs operable to emit light of two different colors. In one example embodiment, the LED devices include a group of LEDs, wherein each LED, if and when illuminated, emits light having dominant wavelength from 440 to 480 nm. The LED devices include another group of LEDs, wherein each LED, if and when illuminated, emits light having a dominant wavelength from 605 to 630 nm. A phosphor can be used that, when excited, emits light having a dominant wavelength from 560 to 580 nm, so as to form a blue-shifted-yellow light with light from the former LED devices. In another example embodiment, one group of LEDs emits light having a dominant wavelength of from 435 to 490 nm and the other group emits light having a dominant wavelength of from 600 to 640 nm. The phosphor, when excited, emits light having a dominant wavelength of from 540 to 585 nm. A further detailed example of using groups of LEDs emitting light of different wavelengths to produce substantially while light can be found in issued U.S. Pat. No. 7,213,940, which is incorporated herein by reference.

The heat sink structure 149 comprises a heat conducting portion or tower 152 and a heat dissipating portion 154 as shown for example in FIGS. 2 and 19-21. In one embodiment the heat sink 149 is made as a one-piece member of a thermally conductive material such as aluminum. The heat sink structure 149 may also be made of multiple components secured together to form the heat structure. Moreover, the heat sink 149 may be made of any thermally conductive material or combinations of thermally conductive materials. The heat conducting portion 152 is formed as a tower that is dimensioned and configured to make good thermal contact with the LED assembly 130 such that heat generated by the LED assembly 130 may be efficiently transferred to the heat sink 149. In one embodiment, the heat conducting portion 152 comprises a tower that extends along the longitudinal axis of the lamp and extends into the center of the enclosure. While the heat conducting portion 152 is shown as being generally cylindrical the heat conducting portion may have any configuration. While heat transfer may be most efficiently made by forming the heat conducting portion 152 and the LED assembly 130 with mating shapes, the shapes of these components may be different provided that sufficient heat is conducted away from the LED assembly 130 that the operation and/or life expectancy of the LEDs are not adversely affected.

The heat dissipating portion 154 is in good thermal contact with the heat conducting portion 152 such that heat conducted away from the LED assembly 130 by the heat conducting portion 152 may be efficiently dissipated from the lamp 100 by the heat dissipating portion 154. In one embodiment the heat conducting portion 152 and heat dissipating portion 154 are formed as one-piece. The heat dissipating portion 154 of heat sink 149 extends from the interior of the lamp to the exterior of the lamp 100 such that heat may be dissipated from the LEDs to the ambient environment. In one embodiment the heat dissipating portion 154 is formed generally as a disk or cylinder that forms an annular ring that sits on top of the open end of the base 102. A plurality of heat dissipating members 158 may be formed on the exposed portion to facilitate the heat transfer to the ambient environment. In one embodiment, the heat dissipating members 158 comprise a plurality fins that extend outwardly to increase the surface area of the heat dissipating portion 154. The heat dissipating portion 154 and fins 158 may have any suitable shape and configuration.

Different embodiments of the LED assembly and heat sink tower are possible. In various embodiments, the LED assembly and heat sink may be relatively shorter, longer, wider or thinner than that shown in the illustrated embodiment. Moreover the LED assembly may engage the heat sink and electronics in a variety of manners. For example, the heat sink may only comprise the heat dissipating portion 154 and the heat conducting portion or tower 152 may be integrated with the LED assembly 130 such that the integrated heat sink portion and LED assembly engage the heat dissipating portion 154 at its base. In some embodiments, the LED assembly and heat sink may be integrated into a single piece or be multiple pieces other than as specifically defined.

The light pattern emitted from the enclosure 112 may be configured to achieve a desired light pattern. While the desired light intensity distribution may comprise any light intensity distribution, in one embodiment the desired light intensity distribution conforms to the ENERGY STAR® Partnership Agreement Requirements for Luminous Intensity Distribution, which is incorporated herein by reference. The structure and operation of lamp 100 of the invention is described with specific reference to the ENERGY STAR® standard set forth above; however, the lamp as described herein may be used to create other light intensity distribution patterns.

The heat sink 149 may be attached to the base 102 using a mechanical snap-fit mechanism such as flexible engagement members 109 on the base 102 that engage second mating engagement members 111 such as apertures on the heat sink structure 149. The snap-fit connection allows the base 102 to be fixed to the heat sink 149 in a simple insertion operation without the need for any additional connection mechanisms, tools or assembly steps. The base may also be fixed to the heat sink using other connection mechanisms such as adhesive, welding, a bayonet connection, screwthreads, friction fit or the like.

A housing 170 is mounted at the base of the optically transmissive enclosure 112 and forms part of the enclosure for the LED assembly 130. The heat sink 149 is configured such that an annular wall 171 is formed at the upper side thereof to create an annular space 179 between the tower 152 and the wall 171. The housing 170 is arranged to reflect light that is directed toward the base 102 back into the enclosure 112 such that the reflected light is emitted from the enclosure 112. The exposed surface **170*a* of the housing 170 may be made of a reflective material and may comprise a white highly reflective material such as injection molded plastic, white optics, PET, MCPET, or other reflective materials. The reflective surface may be made of a specular material. The specular reflectors may be injection molded plastic or die cast metal (aluminum, zinc, magnesium) with a specular coating. Such coatings could be applied via vacuum metallization or sputtering, and could be aluminum or silver. The specular material could also be a formed film, such as 3M's VIKUITI ESR (Enhanced Specular Reflector) film. It could also be formed aluminum, or a flower petal arrangement in aluminum using ALANOD'S MIRO or MIRO SILVER. The reflective surface 170*a*** may also comprise a polished metal surface.

Figure 2:
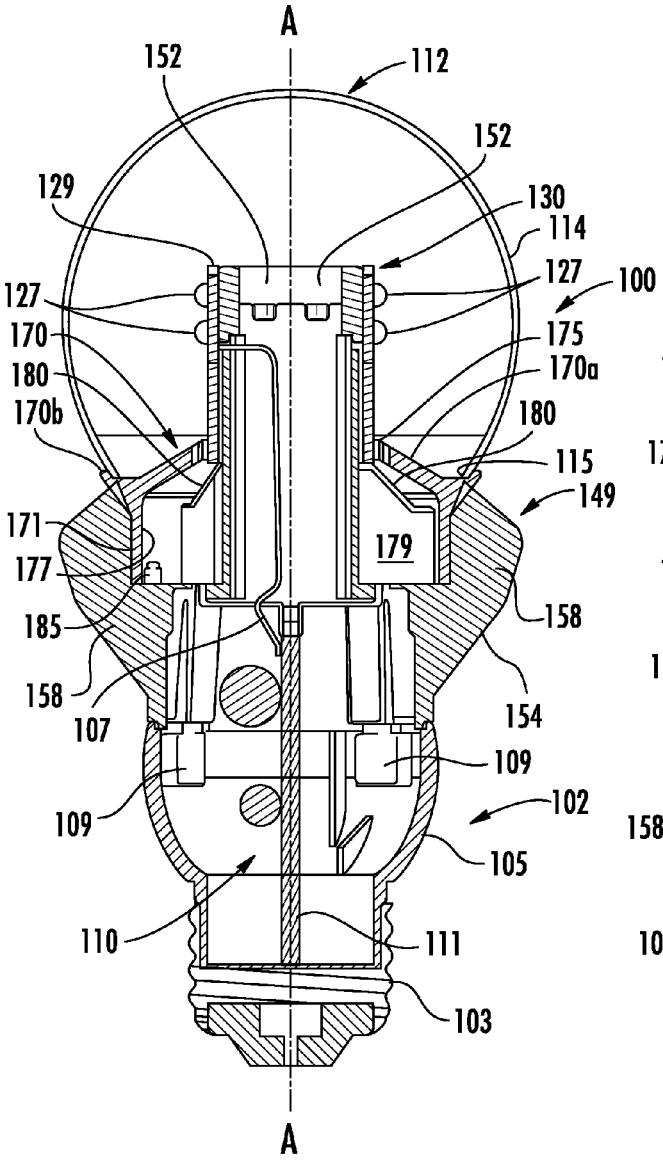
FIG. 2 is a section view of the lamp of FIG. 1.
Figure 3:
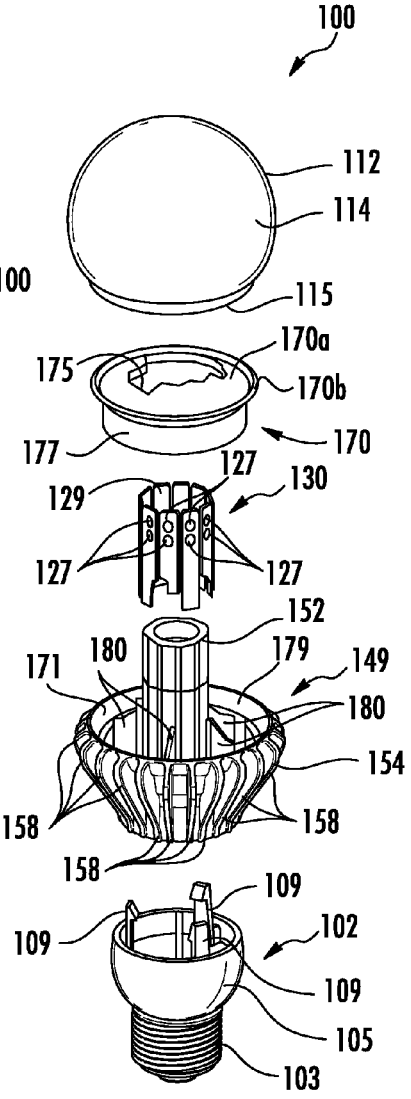
FIG. 3 is an exploded perspective view of the lamp of FIG. 1.
Figure 4:
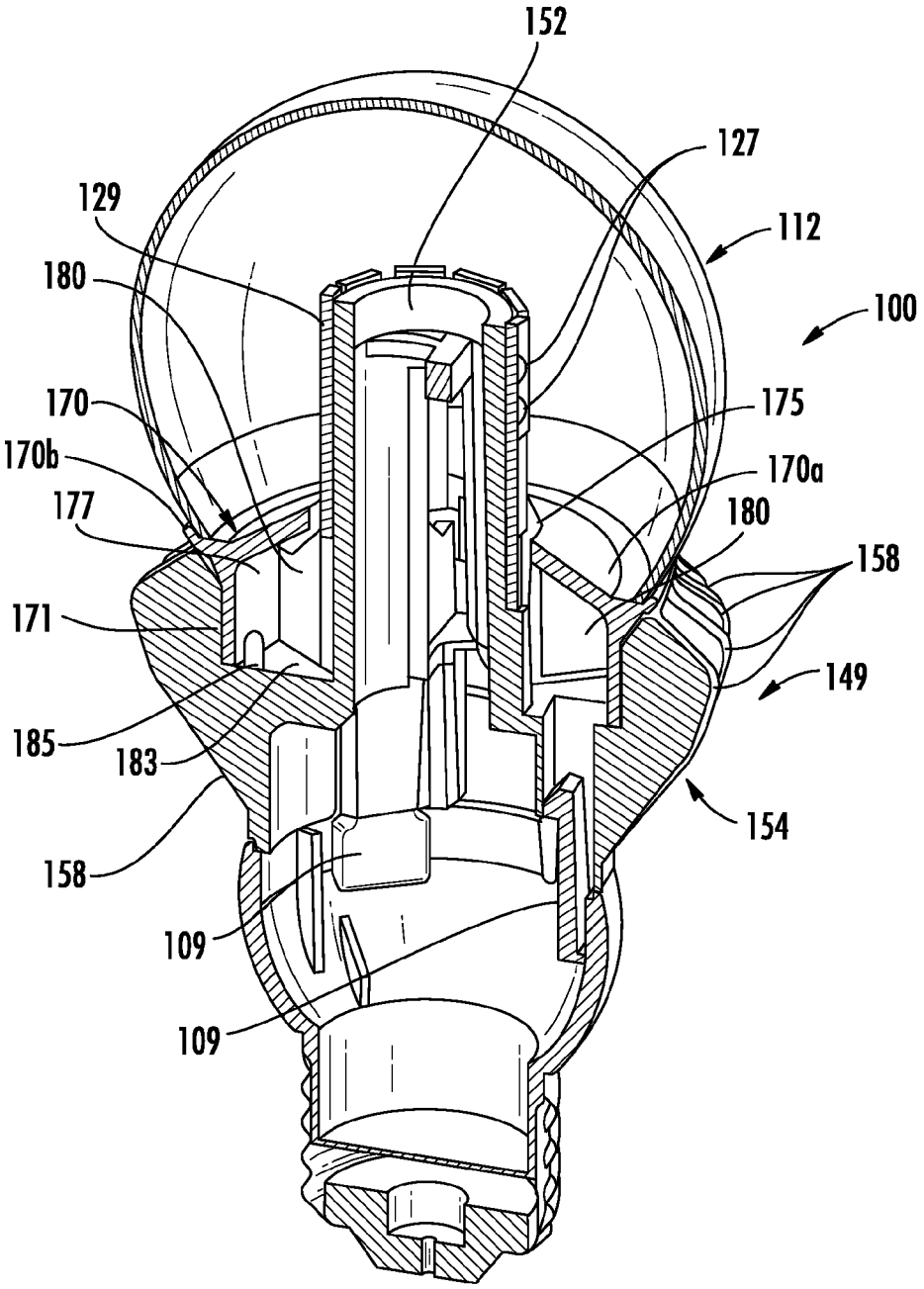
FIG. 4 is a perspective section view of the lamp of FIG. 1.
Figure 5:
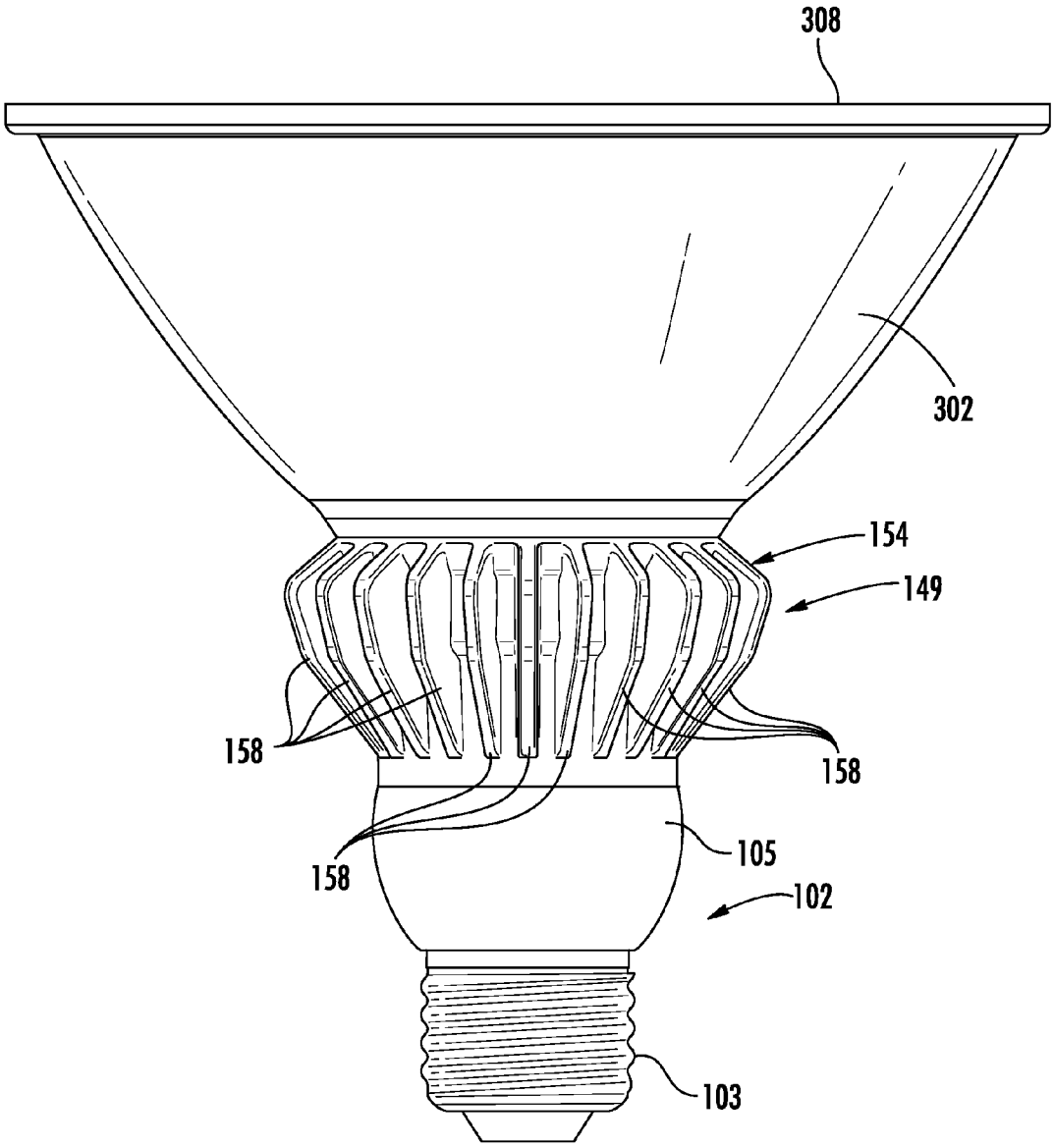
FIG. 5 is a plan view of another embodiment of a lamp of the invention.
Figure 6:
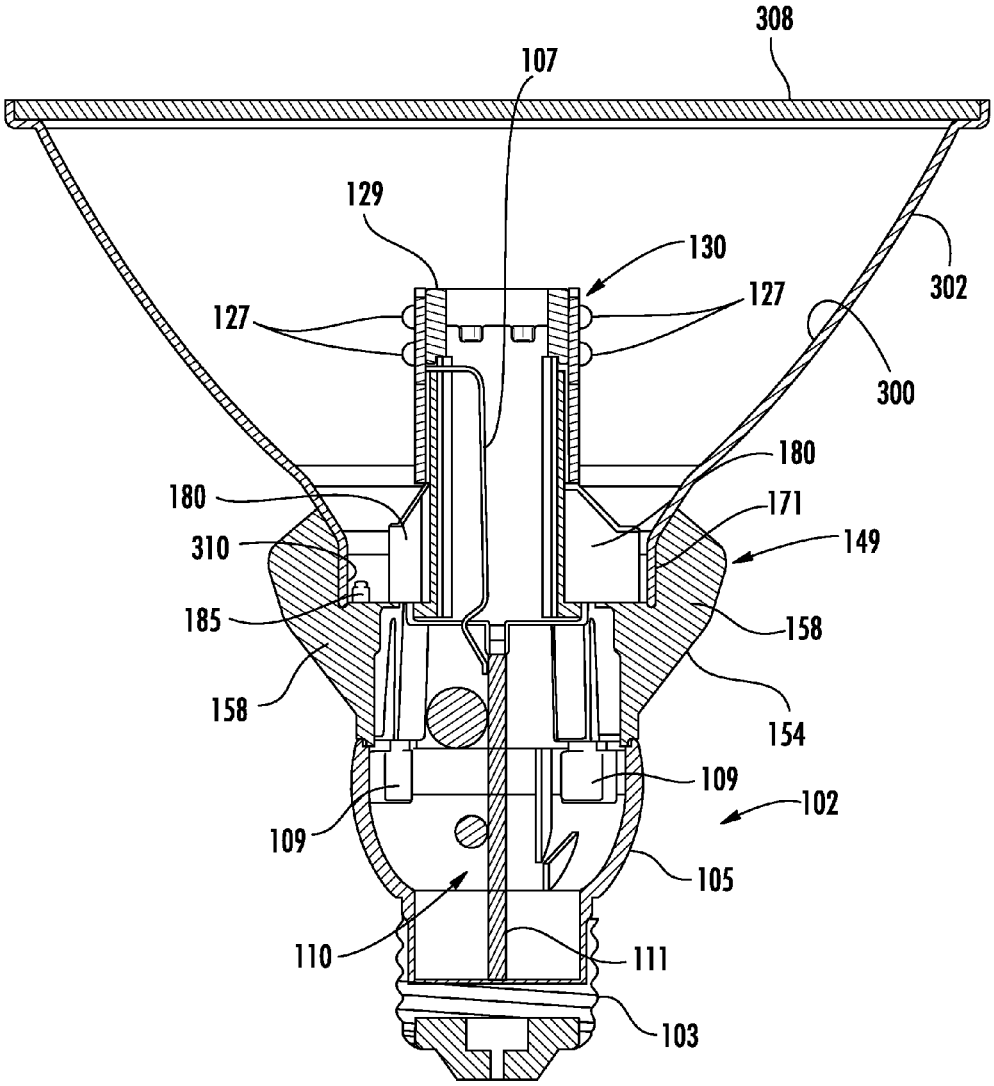
FIG. 6 is a section view of the lamp of FIG. 5.
Figure 7:
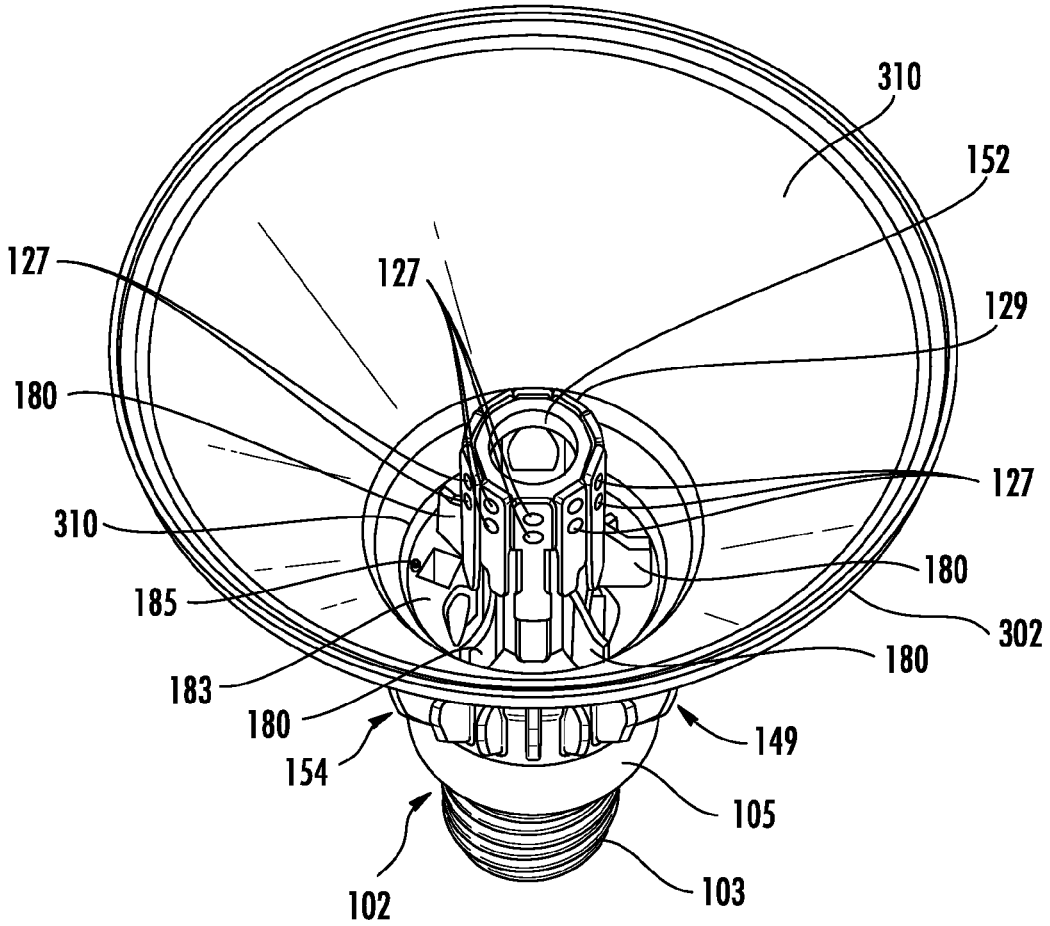
FIG. 7 is a perspective view of the lamp of FIG. 5.
Figure 8:
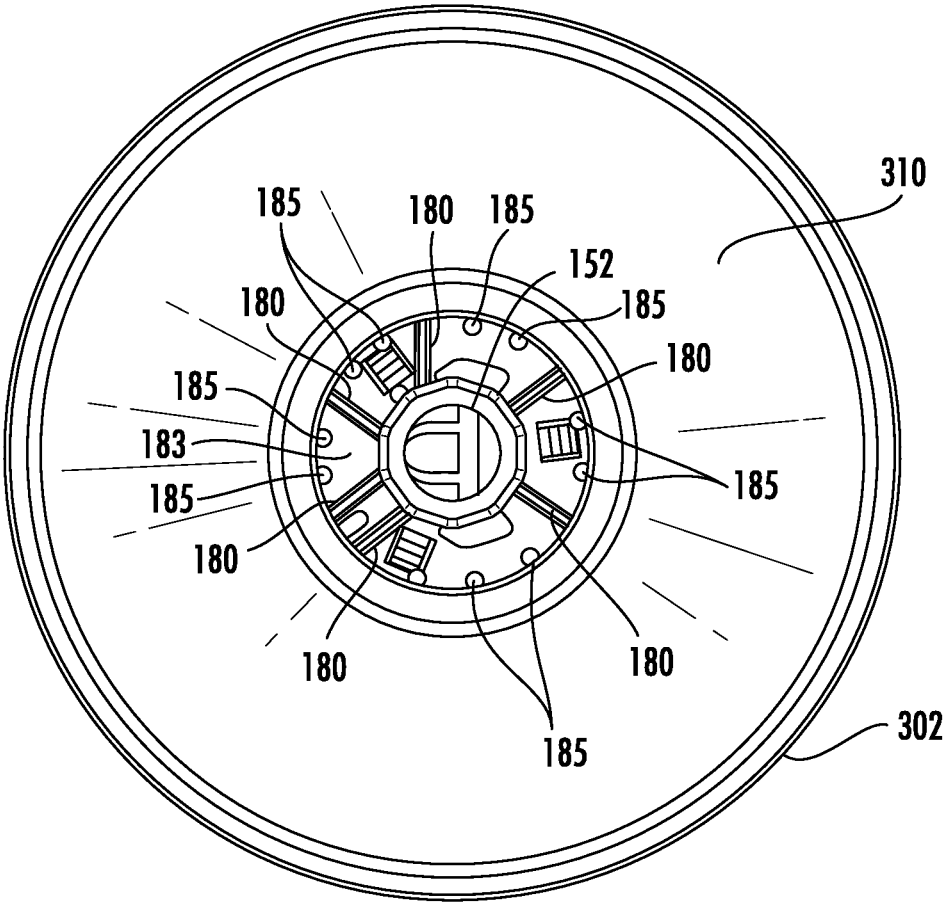
FIG. 8 is a top view of the lamp of FIG. 5.
Figure 9:
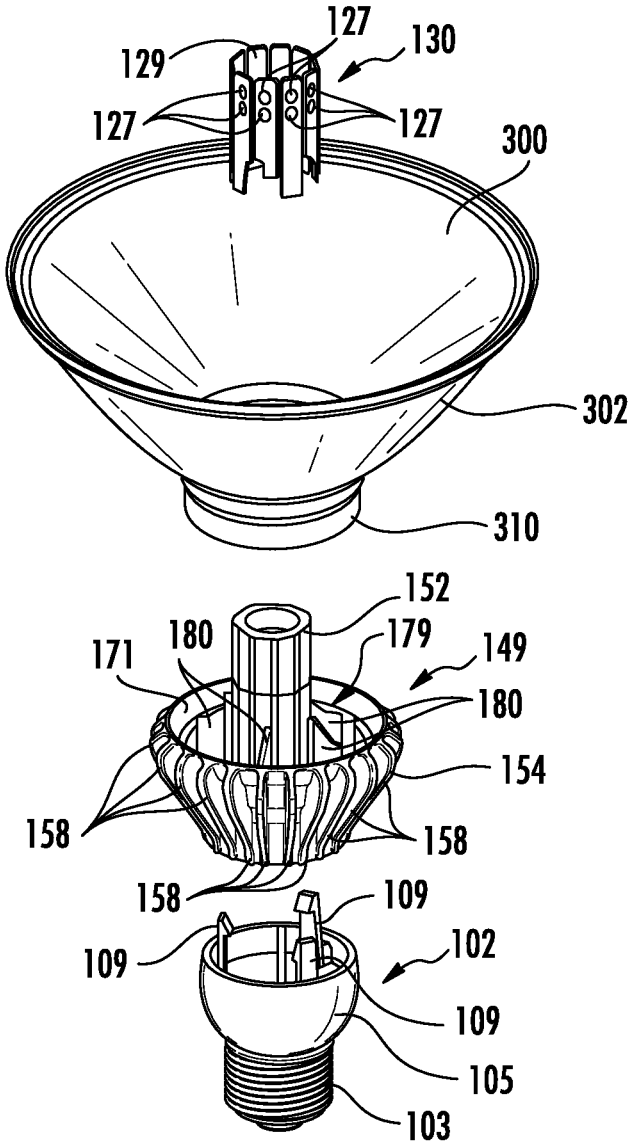
FIG. 9 is an exploded perspective view of the lamp of FIG. 5.

The housing 170 is also arranged to increase the heat transfer from the LED assembly 130 to the heat sink 149. The housing 170 is made of a good heat conductive material such as aluminum although other good heat conducting materials may be used. The housing 170 comprises a central aperture 175 for receiving the tower 152 of the heat sink 149. Aperture 175 may have any suitable shape for receiving the tower 152. The housing 170 is dimensioned such that it is positioned between the heat dissipating portion 154 of the heat sink 149 and the enclosure 112 and at least an edge **170*b* of the housing 170 extends to the outside of the lamp as shown in FIGS. 1 and 2. The housing 170 includes a flange 177 that extends from the bottom of the housing toward the heat dissipating portion 154. The flange 177 is dimensioned such that it is closely received inside of the space 179 such that the flange 177 abuts the wall 171 of the heat sink 149. In the illustrated embodiment the heat sink has a generally cylindrical shape such that the flange 177 and wall 171** have a generally annular shape; however, these components may have other shapes.

In one embodiment, a plurality of fins or flanges 180 extend radially outwardly from the tower portion 152 toward the wall 171. In some embodiments the fins may be disposed behind the housing 170 such that they are not in the enclosure formed by the light transmissive enclosure and the housing. The ends of the flanges 180 are spaced from the wall 171 such that the fins 180 abut the flange 177 on the housing. The fins 180 exert a clamping force on the flange 177 to secure the housing 170 in position on the heat sink 149. The flange 177 is trapped between the fins 180 and the wall 171 such that the fins 180 and the wall 171 hold the flange 171 under a compressive force. The contact between the fins 180 and the flange 177 creates a thermal path between the tower portion 152 of the heat sink 149 and the heat dissipating portion 154 of the heat sink 149. Because a portion of the housing 170 extends to the outside of the lamp 100 the housing 170 also provides a direct thermal path from the heat sink 149 to the ambient environment. The housing may be disposed such that the fins are disposed mostly behind the housing 170.

To assemble the lamp, the heat sink 149 is attached to the base 102 as previously described. The tower portion 152 of the heat sink 149 is inserted through the aperture 175 in the housing 170 and the housing 170 is pushed towards the heat dissipating portion 154 of the heat sink 149 such that the flange 177 is forced into the space between the fins 180 and the annular wall 171. The fins 180 and wall 171 create a compressive force on the flange 177 such that the housing 170 is held in place by a press fit engagement. In some embodiments an adhesive may be applied between the fins 180, the flange 177 and the wall 171 of the heat sink 149 to further secure these components together. The LED assembly 130 may then be mounted on the tower 152 to complete the electrical path between the base 102 and the LEDs 127.

In some embodiments, a series of protrusions 185 are provided on base 183 that are spaced from the wall 171 a distance to receive the distal edge of flange 177. The protrusions 185 engage the distal end of wall 171 to maintain the flange 177 against the wall over substantially the entire surface area of the flange 177. The protrusions guide the flange 177 into position against the wall '171 and prevent the flange 177 from separating from the wall 171.

The enclosure 112 may be secured to the lamp subassembly. In one embodiment, the LED assembly 130 and the heat conducting portion 152 are inserted into the enclosure 112 through the neck 115. The neck 115 and housing 170 are dimensioned and configured such that the edge of neck 115 that defines the aperture into the enclosure 112 sits on the upper surface of the housing 170 with the housing 170 disposed at least partially outside of the enclosure 112, positioned between the enclosure 112 and the heat dissipating portion 154 of heat sink 149. To secure these components together a bead of adhesive may be applied to the upper surface 170*a* of the housing 170. The rim of the enclosure 112 may be brought into contact with the bead of adhesive to secure the enclosure 112 to the housing 170 to complete the lamp assembly.

As shown, a portion of the housing 170 extends to the exterior of the lamp to act as a heat sink that provides a direct thermal path to the exterior of the lamp. The housing 170 is also in contact with the heat sink 149 such that heat is also transferred from fins 180 through the housing 170 to the heat sink 149. The tight press fit engagement between the fins 180, flange 177 and the heat sink 149 creates an additional heat flow path from the LED assembly 130 to the heat sink 149 and to the exterior of the lamp to increase the thermal transfer of heat away from the LEDs 127 to the ambient environment.

Figure 11:
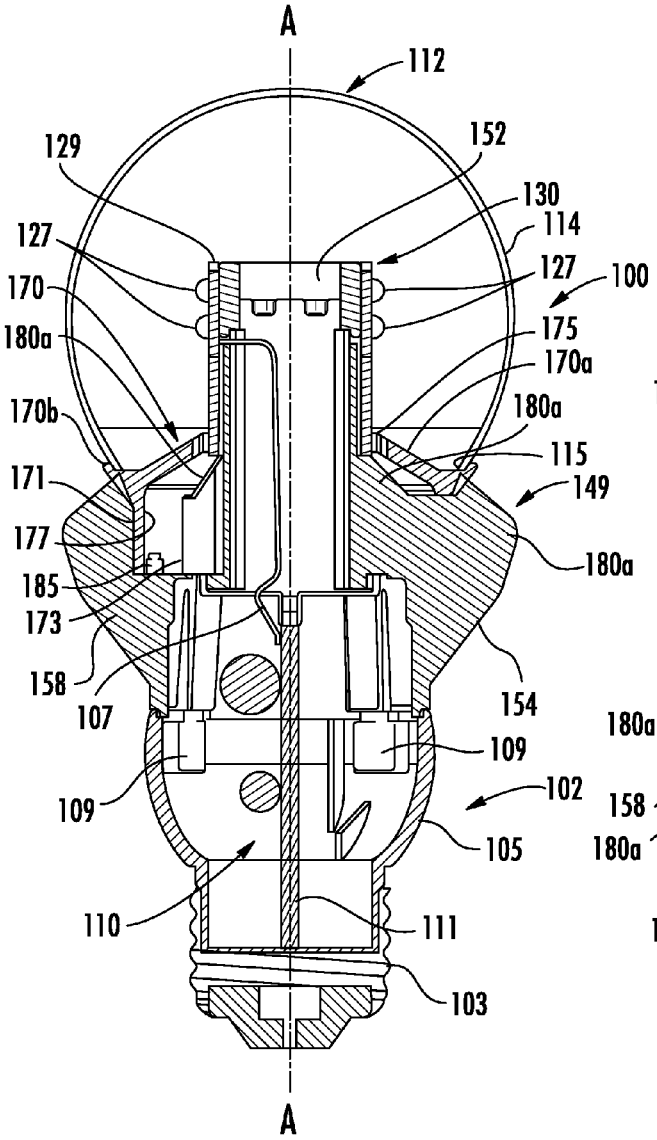
FIG. 11 is a section view of another embodiment of a lamp of the invention.
Figure 12:
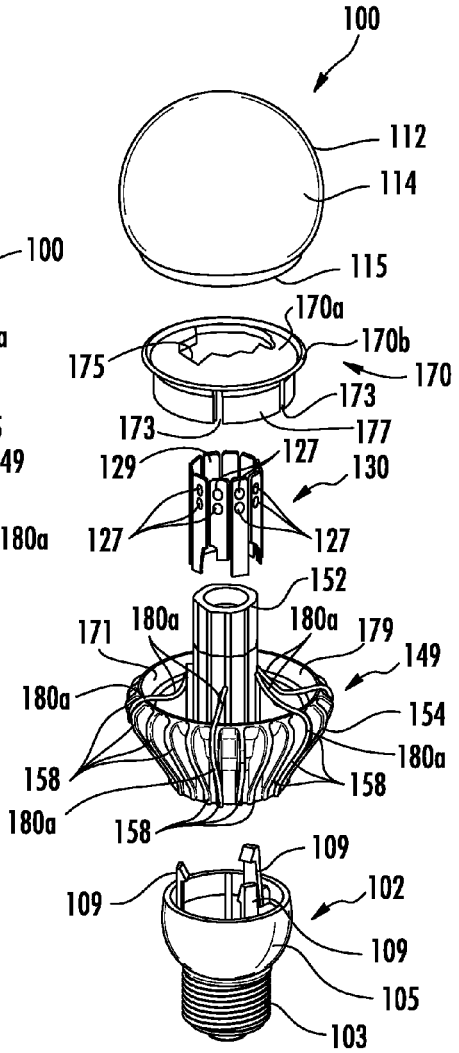
FIG. 12 is an exploded perspective view of the lamp of FIG. 11.

FIGS. 11 and 12 show another embodiment of an omnidirectional lamp that is similar to the lamp shown in FIGS. 1-4 where like reference numerals are used to identify components previously described with reference to FIGS. 1-4. The lamp of FIGS. 11 and 12 differs from the lamp of FIGS. 1-4 in that the fins 180*a* that are formed on the inside of enclosure 112 and that are thermally connected to the tower 152 extend from the interior of the enclosure 112 directly to the exterior of the enclosure. The fins 180*a* are not spaced from the annular wall 171 of the heat sink 149, as described with respect to the preceding embodiments, such that no gap is formed between the fins 180*a* and the wall 171 of the heat dissipating portion 154 of the heat sink. In this embodiment the fins 180*a* transmit heat from the tower 152 directly to the exterior of the lamp. The fins 180*a* also may transfer heat to the housing 170 due to contact between the fins 180*a* and the housing 170. Because a space is not created between the fins 180*a* and the wall 171 for receiving the housing, the housing 170 is formed with apertures or slots 173 in flange 177 that receive the fins 180*a* such that the slots 173 fit over and around the fins 180*a* and allow the fins 180*a* to extend through the flange 177. The slots 173, fins 180*a*, flange 177, and wall 171 may be shaped and dimensioned such that a tight compression fit is created between these components to secure the housing 170 to the heat sink 149. In some embodiments separate fasteners such as mechanical fasteners, adhesive or the like may be used to secure the housing 170 to the heat sink 149.

FIGS. 5-9 show an embodiment of a lamp that uses the LED assembly 130, heat sink with the tower arrangement 149, and base 102 as previously described but in a BR and/or PAR type lamp. The previous embodiments of a lamp refer more specifically to an omnidirectional lamp such as an A19, A21, and/or A23 replacement bulb. In the BR or PAR lamp shown in FIGS. 5-9 the light is emitted in a directional pattern rather than in an omnidirectional pattern. Standard PAR bulbs are reflector bulbs that reflect light in a direction where the beam angle is tightly controlled using a parabolic reflector. PAR lamps may direct the light in a pattern having a tightly controlled beam angle such as, but not limited to, 10°, 25° and 40°. Standard BR type bulbs are reflector bulbs that reflect light in a directional pattern; however, the beam angle is not tightly controlled and may be up to about 90-100 degrees or other fairly wide angles. The bulb shown in FIGS. 5-9 may be used as a solid state replacement for such BR, PAR or reflector type bulbs or other similar bulbs.

The lamp comprises a base 102, heat sink 149, and LED assembly 130 as previously described. As previously explained, the LED assembly 130 generates an omnidirectional light pattern. To create a directional light pattern, a reflective surface 300 may be provided inside of the lamp housing 302 that reflects light generated by the LED assembly 130 generally in a direction along the axis of the lamp. The reflective surface 300 surrounds the LED assembly 130 and reflects some of the light generated by the LED assembly 130. Because the reflective surface 300 may be at least 95% reflective, the more light that hits the reflective surface 300 the more efficient the lamp. The reflective surface 300 may reflect the light in a narrow beam angle. The reflective surface 300 may comprise a variety of shapes and sizes provided that light reflecting off of the reflective surface is reflected generally along the axis of the lamp in a relatively narrow beam angle. The reflective surface 300 may, for example, be conical, parabolic, hemispherical, faceted or the like. In some embodiments, the reflective surface 300 may be a diffuse or Lambertian reflector and may be made of a white highly reflective material such as injection molded plastic, white optics, PET, MCPET, or other reflective materials. The reflective surface may reflect light but also allow some light to pass through it. The reflective surface may be made of a specular material. The specular reflectors may be injection molded plastic or die cast metal (aluminum, zinc, magnesium) with a specular coating. Such coatings could be applied via vacuum metallization or sputtering, and could be aluminum or silver. The specular material could also be a formed film, such as 3M's VIKUITI ESR (Enhanced Specular Reflector) film. It could also be formed aluminum, or a flower petal arrangement in aluminum using ALANOD'S MIRO or MIRO SILVER sheet. The reflective surface 300 may also comprise a polished metal surface. For example, where housing 302 is made of a material such as aluminum the interior surface of the housing may be polished. Some of the light generated by the LED assembly 130 may also be projected directly out of the exit surface 308 without being reflected by the reflective surface 300. In some embodiments the reflective surface may comprise an inside surface of the housing 302 and may include a reflective layer applied to or attached to the interior surface of the housing.

Figure 10:
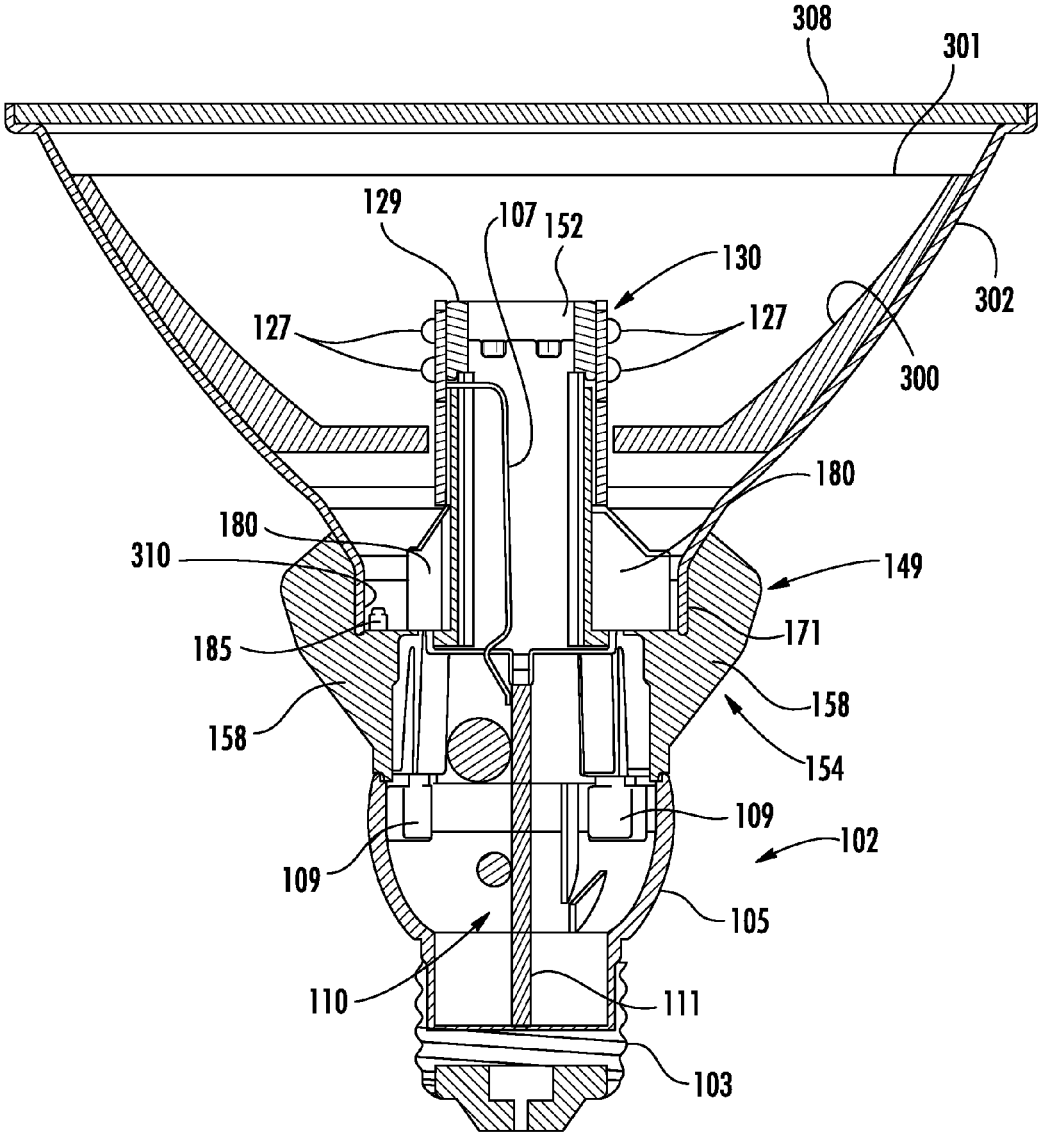
FIG. 10 is a section view of yet another embodiment of a lamp of the invention.

In other embodiments the reflective surface 300 may be formed as a part of a separate reflector component 301 that is mounted inside of housing 302 as shown in FIG. 10. The reflector component 301 is mounted inside of the housing 302 such that the reflective surface 300 of the reflector component 301 reflects the light emitted from the LED assembly in a desired pattern. The reflector component 301 may be attached to the housing 302 such as by using adhesive, welding mechanical connection or a separate fastener. The reflector component 301 may also be secured to the heat sink 149 and/or LED assembly 130 in place of or in addition to being secured to the housing 302. In some embodiments, the reflector component 301 may be a diffuse or Lambertian reflector and may be made of a white highly reflective material such as injection molded plastic, white optics, PET, MCPET, or other reflective materials. The reflector component may reflect light but also allow some light to pass through it. The reflective surface may be made of a specular material. The specular reflectors may be injection molded plastic or die cast metal (aluminum, zinc, magnesium) with a specular coating. Such coatings could be applied via vacuum metallization or sputtering, and could be aluminum or silver. The specular material could also be a formed film, such as 3M's VIKUITI ESR (Enhanced Specular Reflector) film. It could also be formed aluminum, or a flower petal arrangement in aluminum using ALANOD'S MIRO or MIRO SILVER sheet. The reflective surface 300 and/or reflector component 301 may also comprise a polished metal surface.

The housing 302 comprises a thermally conductive material such as aluminum although other thermally conductive materials may be used. The housing 302 includes a flange 310 that extends from the bottom of the housing 302. The flange 310 may define the opening into the housing 302 for receiving the LED assembly and tower 152. The flange 310 is dimensioned such that it is closely received inside of the space 179 formed in the heat sink 149 such that the flange 310 abuts the wall 171 of the heat sink 149. In one embodiment the tower portion 152 includes a plurality of fins or flanges 180 as previously described that extend generally radially from the tower portion 152 toward the wall 171. The ends of the fins 180 are spaced from the wall 171 such that the fins 180 abut the flange 310 on the housing 302 to trap the flange 310 between the fins 180 and the wall 171. The fins 180 and wall 171 exert a clamping force on the flange 310 to secure the housing 302 to the heat sink 149. In the illustrated embodiment the heat sink 149 has a generally cylindrical shape such that the flange 310 and wall 171 have a generally annular shape; however, these components may have other shapes.

To assemble the lamp, the heat sink 149 is attached to the base 102 as previously described. The tower portion 152 of the heat sink 149 is inserted through the aperture in the housing 302 formed by flange 310. The housing 302 is pushed towards the heat sink 149 such that the flange 310 is forced into the space between the fins 180 and the wall 171. The fins 180 and wall 171 create a compressive force on the flange 310 such that the housing 302 is held in place by a press fit engagement. In some embodiments an adhesive may be applied between the fins 180, flange 310 and the heat sink 149 to further secure these components together. If a separate reflector component 301 is used, the reflector component is mounted in the housing 302 as previously described. The LED assembly 130 is mounted on the tower portion 152 of heat sink 149 to complete the electrical path between the base 102 and the LEDs 127.

Figure 13:
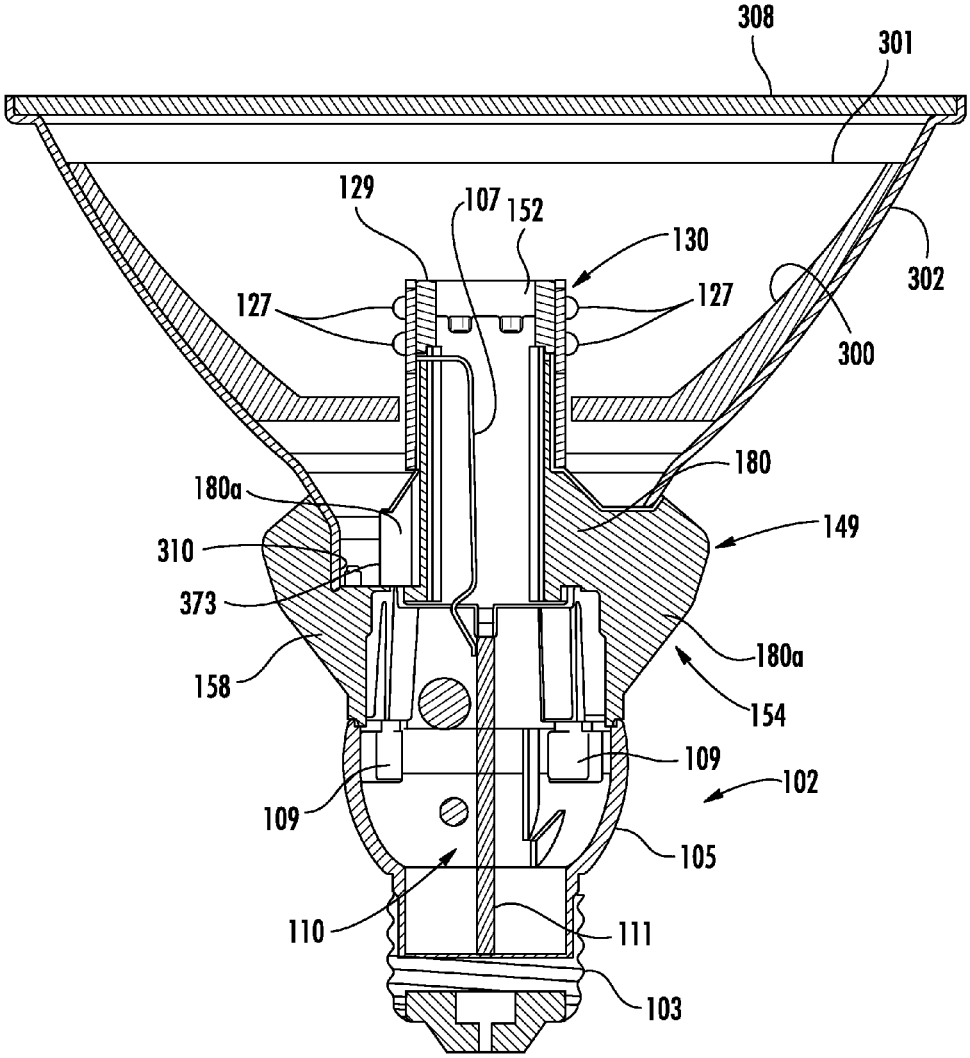
FIG. 13 is a section view of another embodiment of a lamp of the invention.
Figure 14:
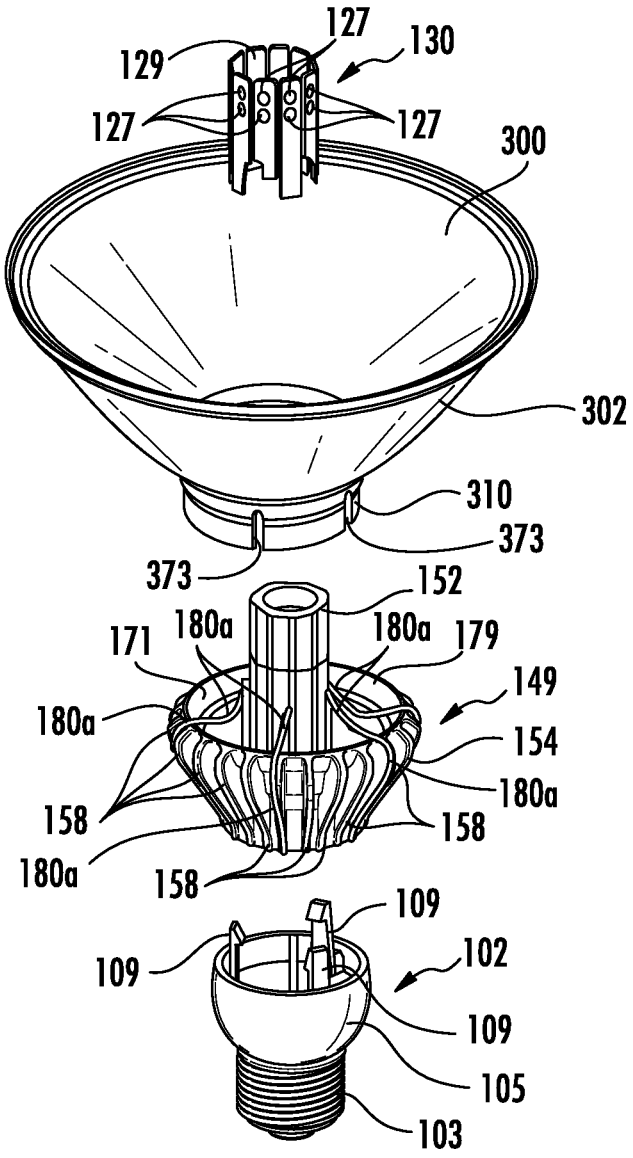
FIG. 14 is an exploded perspective view of yet another embodiment of the lamp of the invention.

FIGS. 13 and 14 show other embodiments of an omnidirectional lamp that is similar to the lamp shown in FIGS. 5-10 where like reference numerals are used to identify components previously described with reference to FIGS. 5-10. The lamp of FIG. 13 shows an embodiment of a directional lamp with the reflector component 301 and the lamp of FIG. 14 shows an embodiment of a directional lamp without the reflector component 301. The lamps of FIGS. 13 and 14 differ from the lamps of FIGS. 5-10 in that the fins **180*a* that are formed on the inside of enclosure and that are thermally connected to the tower 152 extend from the interior of the enclosure directly to the exterior of the enclosure. The fins 180*a* are not spaced from the annular wall 171 of the heat sink 149 such that no gap is formed between the fins 180*a* and the annular wall 171 of the heat dissipating portion 154 of the heat sink 149. In this embodiment the fins 180*a* transmit heat from the tower 152 directly to the exterior of the lamp. The fins 180*a* also may transfer heat to the housing 302 due to contact between the fins 180*a* and the housing 302. Because a space is not created between the fins 180*a* and the wall 171 for receiving the housing, the housing 302 is formed with apertures or slots 373 in flange 310 that receive the fins 180*a* such that the slots 373 fit over and around the fins 180*a* and allow the fins 180*a* to extend through the flange 310. The slots 373, fins 180*a*, flange 310, and wall 171 may be shaped and dimensioned such that a tight compression fit is created between these components to secure the housing 302 to the heat sink 149. In some embodiments separate fasteners such as mechanical fasteners, adhesive or the like may be used to secure the housing 302 to the heat sink 149**.

As shown in FIGS. 5-10 in a PAR or BR style lamp a significant portion of the housing 302 extends to the exterior of the lamp to act as a heat sink that provides a direct thermal path to the exterior of the lamp. The housing 302 is also in contact with the heat sink 149 such that heat is also transferred through the housing 302 to the heat sink 149. The tight press fit engagement between the fins 180, flange 310 and the heat sink 149 creates a heat flow path from the LED assembly 130 to the heat sink 149 and to the exposed housing 302 to increase the thermal transfer from the LEDs 127 to the ambient environment.

A lens 308 may be secured over or to the exit opening of the housing 302 to define the optically transmissive portion of the enclosure. Lens 308 may include a surface texture to provide diffusion for light exiting the lamp. The surface texture may comprise of dimpling, frosting, etching, coating or any other type of texture that can be applied to a lens to diffuse the light exiting the lamp. The textured surface of the lens can be created in many ways. For example, a smooth surface could be roughened. The surface could be molded with textured features. Such a surface may be, for example, prismatic in nature. A lens according to embodiments of the invention can also consist of multiple parts co-molded or co-extruded together. For example, the textured surface could be another material co-molded or co-extruded with the portion of the lens.

The use of the housing 302 as the heat sink may be particularly useful in higher power lamps, such as 90 watt PAR/BR style lamps and higher power lamps, where more heat is generated that may be dissipated to the ambient environment over the relatively large surface area of the housing 302. While the arrangement is particularly beneficial with higher power lamps the arrangement may be used in any size lamp.

In addition to increasing the transfer of heat away from the LED assembly, the fins 180 also facilitate the manufacture of the heat sink. In one embodiment of a molding process for the heat sink the injection points into the mold cavity are located in the area of heat dissipation portion 154 and may be adjacent or between the fins 158. As a result the mold flow flows across the base 183 of the heat dissipation portion and into the bottom of the tower 152. The flow must then flow from the base of the tower to the distal end of the tower to completely fill the mold. Using the fins 180 the flow fills the fins 180 and enters into the tower at a point midway between the base 183 and the end of the tower 152. As a result, the mold flow does not have to traverse the entire length of the tower. The tower 152 is able to be filled with flow faster and more easily when compared to a heat sink that does not include the fins 180.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

an enclosure being at least partially optically transmissive;

a base;

at least one LED located in the enclosure and operable to emit light when energized through an electrical path from the base;

a heat sink comprising a heat dissipating portion that is at least partially exposed to the ambient environment and a heat conducting portion that is thermally coupled to the at least one LED such that a first heat transfer path is created between the at least one LED and the ambient environment;

a housing made of a thermally conductive material and at least partially defining the enclosure, the housing being contacted by the heat dissipating portion and the heat conducting portion such that the housing forms a second heat transfer path from the interior of the enclosure to the ambient environment.

2. The lamp of claim 1 wherein the base comprises an Edison connector.

3. The lamp of claim 1 wherein the at least one LED is mounted on the heat sink in a center of the enclosure.

4. The lamp of claim 1 wherein the at least one LED is attached to a submount and the submount is thermally and mechanically coupled to the heat sink.

5. The lamp of claim 1 wherein the housing supports at least a portion of the enclosure.

6. The lamp of claim 1 wherein the housing is at least partially exposed to an exterior of the lamp.

7. The lamp of claim 1 wherein the housing supports a lens.

8. The lamp of claim 1 wherein the housing supports a reflective surface.

9. The lamp of claim 8 wherein the reflective surface is part of a reflector component mounted inside of the housing.

10. The lamp of claim 1 wherein the heat conducting portion comprises fins that engage the housing.

11. The lamp of claim 10 wherein the housing comprises a flange that is trapped between the fins and a wall of the heat sink.

12. The lamp of claim 10 wherein a thermal path is created between the heat conducting portion and the housing through the fins.

13. A lamp comprising:

an enclosure defining an internal space being at least partially optically transmissive;

a base;

at least one LED located in the enclosure and operable to emit light when energized through an electrical path from the base;

a heat sink comprising a heat dissipating portion that is at least partially exposed to the ambient environment and a heat conducting portion that is thermally coupled to the at least one LED and is located at least partially inside of the enclosure;

a thermally conductive housing press fit to the heat sink such that a thermal path is created between the heat sink and the housing where at least a first portion of the housing is external to the enclosure and a second portion of the housing is inside of the enclosure in the internal space such that heat is conducted through the housing to the ambient environment.

14. The lamp of claim 13 wherein the housing is press fit between a first portion of the heat sink and a second portion of the heat sink.

15. A lamp comprising:

an enclosure being at least partially optically transmissive;

a base;

at least one LED located in the enclosure and operable to emit light when energized through an electrical path from the base;

a heat sink comprising a heat dissipating portion that is at least partially exposed to the ambient environment and a heat conducting portion comprising a tower that extends into the enclosure and that is thermally coupled to the at least one LED, and at least one fin physically extending from and thermally coupled to the tower, the at least one fin being partially located within the enclosure and extending from an interior of the enclosure to an exterior of the enclosure;

a housing thermally coupled to the heat sink, the housing being made of thermally conductive material and being at least partially exposed to the ambient environment, the housing defining at least a portion of the enclosure.

16. The lamp of claim 15 wherein the housing is press fit to the heat sink.

17. The lamp of claim 16 wherein the housing is press fit between the at least one fin and a portion of the heat sink.

18. A lamp comprising:

an enclosure having an interior and being at least partially optically transmissive;

a base comprising electrical connections;

at least one LED located in the enclosure and operable to emit light when energized through the electrical connections in the base;

a heat sink comprising a heat dissipating portion that is at least partially exposed to the ambient environment and a heat conducting portion comprising a tower that extends into the enclosure and that is thermally coupled to the at least one LED, and at least one fin physically extending from and thermally coupled to the tower, the at least one fin being partially located within the enclosure and extending from the interior of the enclosure to an exterior of the enclosure.

* * * * *